US011951369B2

(12) United States Patent
Ognibene et al.

(10) Patent No.: US 11,951,369 B2
(45) **Date of Patent: *Apr. 9, 2024**

(54) SUSPENSION SYSTEM

(71) Applicants: Ryan Charles Ognibene, Boulder, CO (US); Bradley Thomas Miles, Superior, CO (US); James Warren Hurt, Boulder, CO (US)

(72) Inventors: Ryan Charles Ognibene, Boulder, CO (US); Bradley Thomas Miles, Superior, CO (US); James Warren Hurt, Boulder, CO (US)

(73) Assignee: Lever, LLC, Boulder, CO (US)

( * ) Notice: Subject to any disclaimer, the term of this patent is extended or adjusted under 35 U.S.C. 154(b) by 65 days.

This patent is subject to a terminal disclaimer.

(21) Appl. No.: 17/579,560

(22) Filed: Jan. 19, 2022

(65) Prior Publication Data

US 2022/0143481 A1 May 12, 2022

Related U.S. Application Data

(63) Continuation-in-part of application No. 16/858,570, filed on Apr. 24, 2020, now Pat. No. 11,259,982.

(51) Int. Cl.
*A63B 21/04* (2006.01)
*A63B 21/00* (2006.01)
(Continued)

(52) U.S. Cl.
CPC ..... *A63B 69/0064* (2013.01); *A63B 21/0442* (2013.01); *A63B 21/0552* (2013.01); *A63B 21/154* (2013.01); *A63B 21/4009* (2015.10); *A63B 22/02* (2013.01); *A63B 24/0062* (2013.01); *A63B 71/0622* (2013.01);
(Continued)

(58) Field of Classification Search
CPC ..... A61H 1/0229; A61H 1/00; A61H 3/008; A61H 2201/5043; A61H 2201/163; A61H 2201/1261; A61H 2201/0192; A61H 2201/0157; A63B 21/00181; A63B 21/0442; A63B 21/0557; A63B 21/065; A63B 21/058; A63B 21/155; A63B 21/156; A63B 21/4009; A63B 21/4043; A63B 21/00047; A63B 21/00178; A63B 22/02; A63B 69/0064; A63B 2071/065; A63B 2071/0622
See application file for complete search history.

(56) References Cited

U.S. PATENT DOCUMENTS 6,554,747 B1 * 4/2003 Rempe ..... A63B 21/4011 482/69
8,920,347 B2 * 12/2014 Bayerlein ..... A63B 21/00181 601/5
(Continued)

*Primary Examiner* — Megan Anderson

(57) ABSTRACT

The suspension system disclosed may be used to provide anti-gravity or pro-gravity affects to aid in exercise and rehabilitation. The system includes a frame assembly which supports an elastic cord. The elastic cord supports a portion of the weight of the user and exerts upward or downward pressure on the user to reduce or enhance the user's weight. The elastic is configured to equalize the forces on the system and permit free movement of the user while reducing or enhancing the user's weight. The system may be used by itself or with a number of different exercises and equipment.

20 Claims, 32 Drawing Sheets

(51) Int. Cl.

| | |
|---|---|
| ***A63B 21/055*** | (2006.01) |
| ***A63B 22/02*** | (2006.01) |
| ***A63B 24/00*** | (2006.01) |
| ***A63B 69/00*** | (2006.01) |
| ***A63B 71/06*** | (2006.01) |

(52) U.S. Cl.
CPC ..... *A63B 2071/065* (2013.01); *A63B 2210/50* (2013.01); *A63B 2220/51* (2013.01); *A63B 2225/093* (2013.01)

(56) References Cited

U.S. PATENT DOCUMENTS

| | | | | |
|---|---|---|---|---|
| 2012/0197168 | A1* | 8/2012 | Agrawal | A63B 21/4009 602/19 |
| 2021/0005319 | A1* | 1/2021 | Otsuki | A61B 5/4585 |

* cited by examiner

SUSPENSION SYSTEM

PRIORITY

This utility application claims priority to U.S. Utility application Ser. No. 16/858,570, filed on Apr. 24, 2020, now U.S. Pat. No. 11,259,982, which in turn claims priority to Provisional Patent Application No. 62/838,588, filed on Apr. 25, 2019; the entirety of these applications is hereby incorporated by reference. This application additionally incorporates by reference the entirety of Application PCT/US21/28760 filed on Apr. 23, 2021.

FIELD OF THE INVENTION

This invention relates to exercise and therapy equipment. More particularly, it relates to a gravity-altering suspension system to aid in exercise and therapy.

BACKGROUND

Athletes and physical therapy patients often need a device that can effectively reduce their body weight while exercising. The effective reduction in body weight is beneficial for users for fitness purposes and in particular is beneficial for users that have injuries or are in recovery from injuries. Similarly, sometimes these users may benefit from a perceived increase in body weight for more effective physical training.

There are several devices that are currently available for effectively reducing body weight while exercising on a treadmill or similar piece of exercise equipment. One available device option is an entire treadmill system that uses air pressure to provide anti-gravity functionality. Another device option is an anti-gravity system that is fixed around a treadmill and/or under the bottom of a treadmill. These devices can be cumbersome, are generally stationary (not readily mobile), and do not allow a user to move about freely within the device.

Accordingly, there is a need in the art for a weight-reduction device, or weight-enhancement one, that can readily be transported from one location to another for use on a treadmill, on other gym equipment, or in conjunction with various exercises. Further, there is a need for such a device to be configured for simple, quick and convenient setup. Moreover, there is a need for a device that allows a user to move freely within the device while maintaining effective weight reduction, anti-gravity functionality. The presently disclosed suspension system addresses these needs.

SUMMARY

The presently disclosed suspension system is for effective body weight reduction or enhancement to provide anti-gravity or pro-gravity suspension. The system includes a frame assembly. The frame assembly may be supported in a number of different configuration on a number of different supports as more fully understood from the disclosure. An elastic cord is suspended within the frame assembly and attaches thereto. The configuration of the elastic cord, including where it attaches to the frame assembly and where and how it couples with the user, allow the system to be used in a number of diverse applications for different purposes. The system equalizes the forces throughout the elastic cord to provide an equalized anti-gravity or pro-gravity functionality for the user.

The preceding and following embodiments and descriptions are for illustrative purposes only and are not intended to limit the scope of this disclosure. Other aspects and advantages of this disclosure will become apparent from the following detailed description.

DETAILED DESCRIPTION

Figure 1:
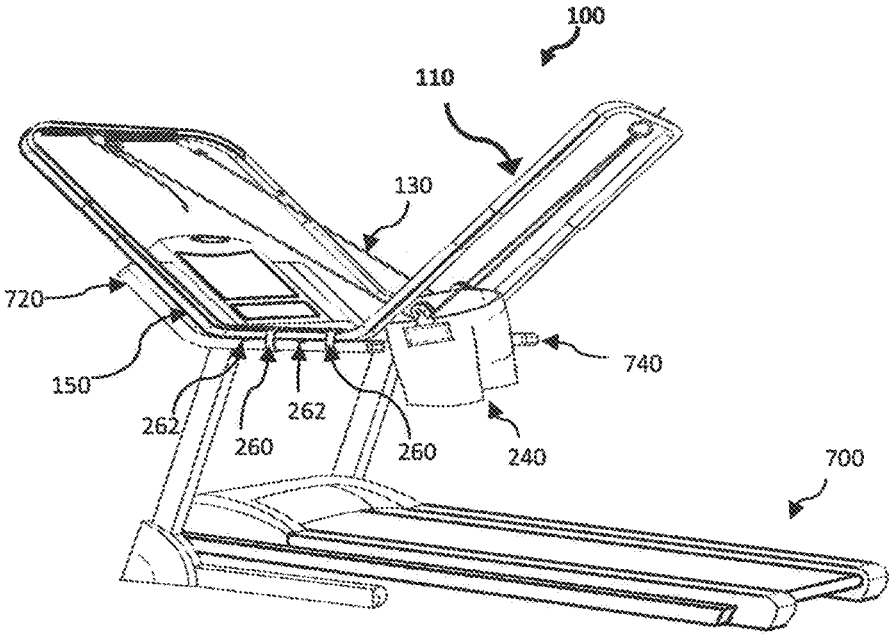
FIG. 1 is an illustrated view of an embodiment of a suspension system attached to a treadmill.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

The presently disclosed system provides for effective weight reduction (or weight increase) and an anti-gravity (or pro-gravity) functionality as detailed herein. In one embodiment, the device readily attaches to the arms of a treadmill and provides lift to a user of the treadmill, thereby providing an effective reduction in weight. In an alternative embodiment, the system readily attaches to a stand that positions the device over a treadmill for use. In yet other embodiments, the system may couple to exercise equipment other than a treadmill. In yet other embodiments, the system may be secured to a wall or other weight-bearing structure or may be placed on a floor.

The suspension system includes a frame that supports a suspension mechanism that lies within the frame. The frame has two opposing base bars which may attach to the arms of a treadmill, to other equipment, to a stand, may rest on a floor, or may be affixed to a wall or other structure. Extending both forward and aft of the base bars are angled support bars that rise up from the base bars to support elevated cross bars that bridge across the ends of the support bars. Accordingly, there is a front cross bar and a rear cross bar, with the front cross bar (facing the front of a treadmill), and the rear cross bar (facing the rear of a treadmill). The frame therefore has two base bars that lie on opposite sides, with each bar having a front end and rear end. Two opposing front support arms extend from the front ends of the base bars, and two opposing rear support arms extend from the rear of the base bars. A front cross bar connects to the upward ends of the front support arms, and a rear cross bar connects to the upward ends of the rear support arms.

Attached to the frame are the inner parts of the suspension mechanism. These parts include an elastic cord or bungee cord that extends from a first half of the front cross bar to a rear support point or points centered about the center of the rear cross bar, and from the rear support point(s) the elastic cord continues to extend back to the front cross bar. Accordingly, a single length of an elastic cord extends from the front of the device to the rear of the device and then back to the front of the device to form a generally V or U shaped cord when viewed from above.

The elastic cord is fixedly or adjustably attached to a first, front point of attachment on a first side of the front cross bar, extends back to and through one or more rear attachment points at the back cross bar, and extends forward to and through an adjustable point of attachment on a second side of the front cross bar that allows for adjustment of the length of the elastic cord. The first and second side points of attachment of the elastic cord to the front cross bar may be centered about the front cross bar, such that each point of attachment is equidistant from the center of the cross bar. The width between the first and second side points of attachment typically is about the width of the distance between a user's hips so as to allow a user to comfortably stand between two central points of the elastic cord that are centered between the front and rear cross bars (in applications where the user will be positioned between the segments of the cord, such as on a treadmill or when performing dips).

The point of attachment of the elastic cord on either side of the front cross bar, or on both sides, is adjustable to allow the length of the elastic cord in the device to be shortened or lengthened as needed for a given individual's height and desired effective weight change. The adjustable elastic cord length allows the effective weight change to be adjusted from none to a desired amount. By adjusting the length of the cord, the tension can be adjusted to provide the desired weight change (reduction or increase) effect.

In another embodiment, the elastic cord passes through two or more fasteners on the rear cross bar that allow the cord to freely move through the fasteners. The two or more fasteners are centered about the center of the rear cross bar. In another embodiment, the position of the two or more rear fasteners can be adjustable, such that they can move from side to side along the rear cross bar. In this configuration, the position of the rear fasteners can be adjusted to provide the system with greater flexibility in accommodating users having different body widths. Likewise, the position of the front fasteners can be adjustable as well to further add to the flexibility of the system with respect to different widths of distances between the hips of different users (in applications where the user will be positioned between the lengths of the cord).

As the elastic cord travels from the front cross bar to the rear cross bar and back to the front cross bar, it feeds through freely moving support devices that are approximately midway between the front and rear cross bars. These freely moving support devices are attached to a pair of shorts or pants worn by a user of the device. The elastic cord runs through the freely moving support devices, through which the elastic cord exerts the upward force that produces the effective weight reduction by the system. Accordingly, the elastic cord is suspended between the front and rear cross bars and is attached to a user of the device midway between the front and rear cross bars to yield an upward, anti-gravity force to the user.

In embodiments where the user's weight need not be supported at his mid-section, for example while doing pushups or pullups, the shorts or pants may be eliminated. Instead, other types of apparel, such as booties or shoe holders, may be used. Alternatively, the user may weight the cord without any additional apparel. Alternatively, a platform may be placed on the cord which receives the user's weight. Moreover, in applications where the device is used to provide pro-gravity affect, the weight of the user is not supported, rather an additional force is added (by a downward action of the cord or by tension of the cord) which is experienced at the user as a net increase in his weight.

The freely moving support devices through which the elastic cord runs through allows forward and rearward movement of the devices relative to the elastic cord. This movement accounts for the forward and rearward movement of a user's body as a user either walks or runs while using the system. In addition, the elastic cord in combination with the freely moving support devices allows for freedom of movement from side to side that can naturally occur as a user walks or runs.

The freely moving support devices may be permanently attached to or integrated into a pair of shorts or pants worn by a user. Alternatively, the freely moving support devices maybe removably attached to the user's leg garments through a readily engaged and subsequently released fastening system. In this manner, the user's leg garments may be attached to the freely moving support devices by buttons, snaps, hook and loop fasteners, cams, and the like.

In application where the user is not running or walking on a treadmill, the suspension system likewise provides maximum freedom of movement for the user and reduces (or enhances) the user's weight by providing a lifting force (or downward force). In these applications, the support devices are correspondingly configured to attach to the appropriate apparel or the particular type of support configured for the particular embodiment of the system.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications, and equivalents. In alternative embodiments, additional devices, or combinations of illustrated devices, may be added to, or combined, without limiting the scope to the embodiments disclosed herein.

Referring to FIG. 1, an embodiment of the present disclosure is shown as a suspension system 100. System 100 is designed for anti-gravity suspension and is attached to a treadmill 700. The system 100 is attached to the treadmill 700 by resting the frame 110 on the arms 720 and 740 of the treadmill 700, and then strapping the system 100 to the arms 720 and 740 by straps 260 (FIG. 2). As detailed below, the system 100 provides lift to a user of a treadmill, thereby providing an anti-gravity, effective weight suspension system.

Figure 2A:
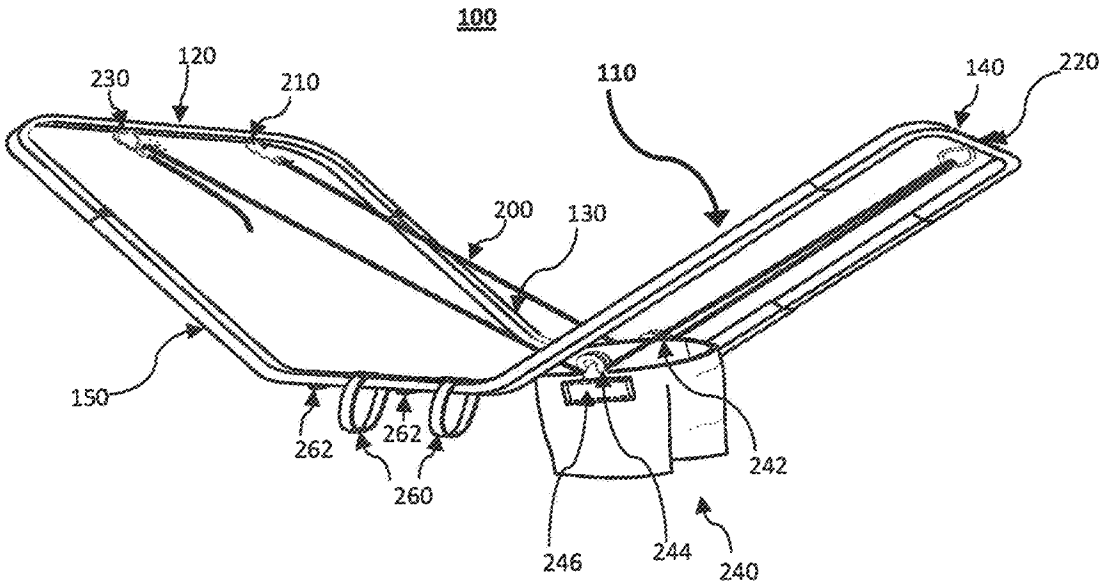
FIG. 2A is an illustrated view of the embodiment shown in FIG. 1.

Turning to FIG. 2A, system 100 is shown detached from a treadmill. Frame 110 is assembled from four members (typically made from bars) that include two (2) side base and angled support arm bars 130, 150, and two (2) cross bars, a first or front bar 120, and a second or rear bar 140. In one non-limiting configuration, the above described base and angled support bars 130 and 150 are integrated into a single bar having a front-extending angled support bar; a horizontal base bar; and a rear-extending angled support bar.

In alternative embodiments, these base and angled support bars need not be integrated into a single bar. Instead they may be formulated as two or more pieces which couple to form the base and angled support bars 130 and 150. The coupled pieces may be releasably coupled, foldably coupled, telescopically coupled, or coupled in any manner which is readily disconnectable or adjustable. As further described below, telescoping or folding capabilities allow the system to be manipulated so that the system can be compacted or altered in shape to achieve the benefits presently disclosed. For example, a smaller device resulting from telescoping bars or folding joints is more readily packaged and shipped. These features not only assist in packaging but also allow resizing of the system to fit a smaller area or in a smaller footprint.

Resizing the system or changing certain shape attributes allows further customization of the system. For example, changing the angles on the side base and angled support arm bars enables increased or decreased tension. Moreover, it permits the present system to be coupled to a wider variety of exercise equipment such as a treadmill with angled arms. Once the base is attached the vertical arms can be adjusted so the horizontal bars can be set up to a similar height removing the need for an adapter between the curved treadmill arms and the unit base. In an embodiment where the side base and angled support arm bars are also telescoping, these angle adjustments with the telescoping feature enables the system to be placed on a short-armed treadmill and effectively move the location where a user should run towards the rear—making these types of treadmills more usable.

In yet another alternative embodiment, any portion of the system may be permanently incorporated into a treadmill or other exercise equipment. For example, the present disclosure contemplates creation of treadmills and exercise equipment with the suspension system described herein being permanently incorporated within it. The permanently incorporated unit may be shipped from the seller altogether or a user may have the option of purchasing the portably unit and later acquiring the treadmill or exercise machine which is configured for permanent attachment to it. These option allow more flexibility for the user and permit him to experiment with the system to discover which embodiment is optimal for his needs.

The outer frame 110 provides support for an inner suspended system that includes an elastic cord 200, attachment points at which the cord 200 attaches to or is suspended by the frame 110, and a pair of leg garments, such as shorts 240 that are suspended from the elastic cord by pulleys 242 and 244. The attachment points for the cord includes a first front attachment point 210 on front cross bar 120; a first rear attachment point 220 on rear cross bar 220; and a second front attachment point 230 on front cross bar 120. Accordingly, the elastic cord runs from first front attachment point 210 to rear attachment point 220 and then back to second front attachment point 230 to form a loop. The elastic cord 200 is slidably threaded through the rear attachment point 220. In this manner, the elastic cord 200 provides suspension for the shorts 240 worn by a user. The shorts 240 are attached to pulleys 242 and 244 by support straps 246. The elastic cord 200 feeds under the pulleys 242 and 244, thereby suspending the shorts 240 from the elastic cord 200.

The suspension structure as disclosed provides for an anti-gravity/effective weight reduction effect through an upward lifting force imparted by the elastic cord. The suspension mechanism provides for an equalized upward force throughout the elastic cord 200. This equalized force is achieved through movement of the elastic cord 200 that is allowed throughout the configuration of the attachment points on the frame. In particular, the configuration allows for the elastic cord to freely move through the attachment point(s) on the rear cross bar, such as that shown in FIG. 2A, which includes attachment point 220 on the rear cross bar 140. Movement that is allowed through the attachment of the elastic cord 200 to suspension pulleys 242 and 244 further contributes to the equalization of lifting force throughout the system 100. Accordingly, a user of the system 100 experiences a lifting force that is equalized and balanced between the right and left sides of the user's body. As detailed below, the movement of the elastic cord 200 within the system 100 further allows a user to freely move forward and backward as well as side to side within the system.

Figure 2B:
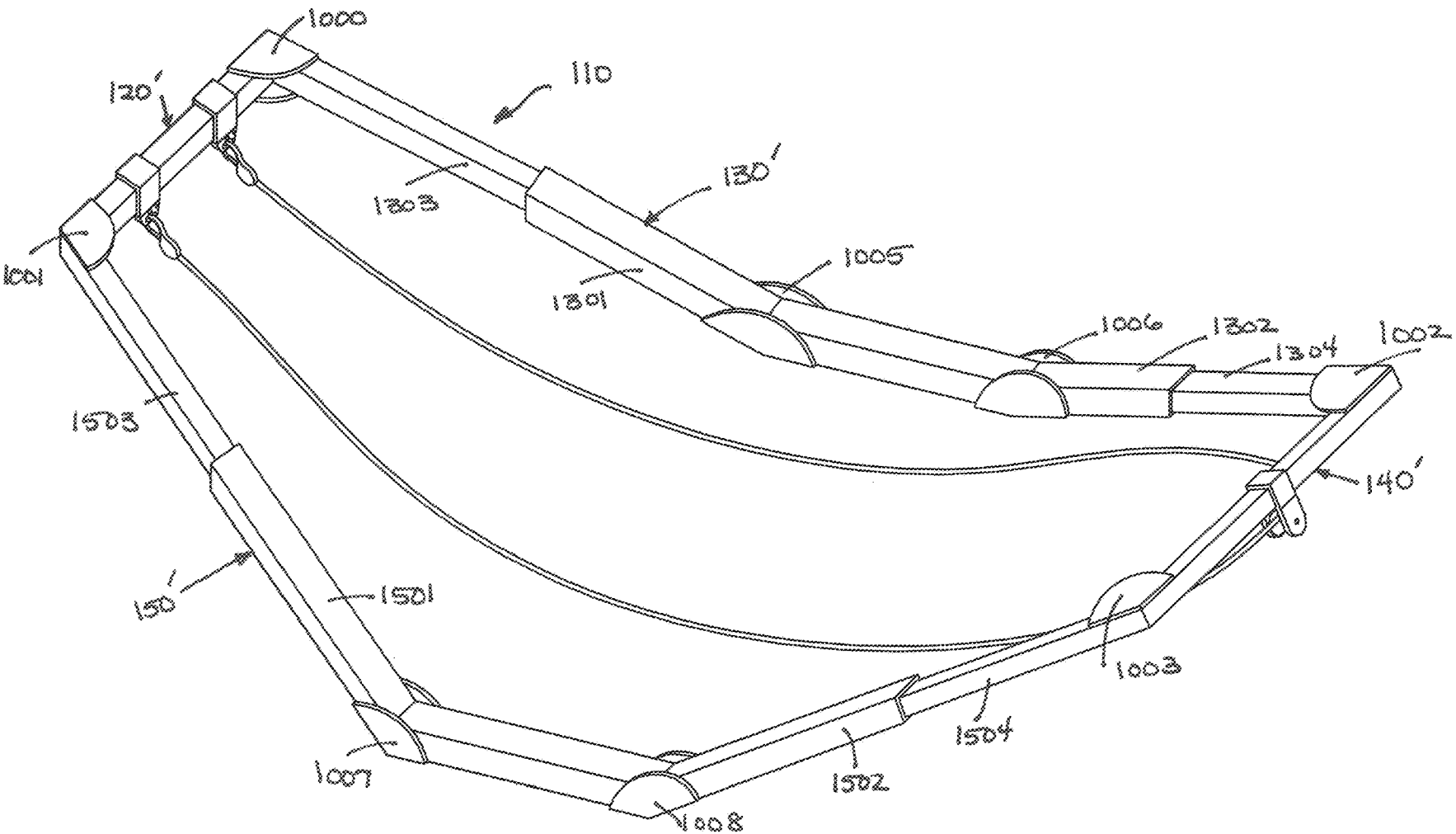
FIG. 2B is an illustrated view of another embodiment of the suspension system.
Figure 2C:
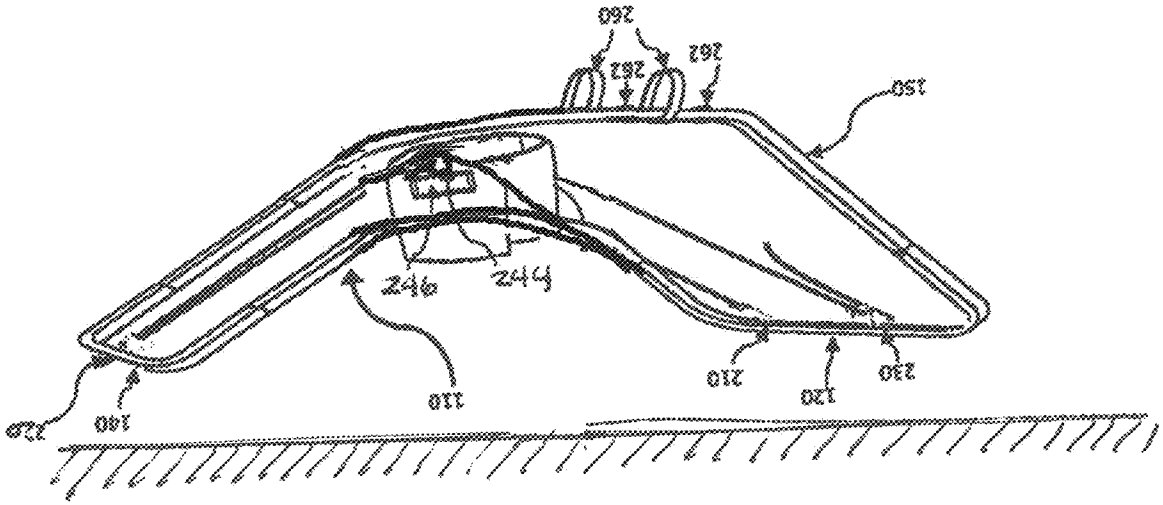
FIG. 2C is an illustrated view of an alternative orientation of the suspension system.

The system as shown in FIG. 2A may also be used in a reverse position where the frame assembly is placed upside down. FIG. 2C illustrates the frame assembly placed in this manner. In this application, the unit may be secured to a treadmill or other equipment in the same manner as explained for FIG. 2A except that the orientation of the frame assembly is rotated towards the ground 180 degrees. In this one embodiment, the horizontal arm is secured to the underside of the treadmill arm or the equipment. Alternatively, the unit may be placed on ground in this upside down orientation. Alternatively, the unit may be coupled to a stand in this upside down orientation.

In this upside down orientation, the attachment points for cord 200 (on the frame assembly) will be below the location where the cord couples to the user (for example at the pulley on the shorts shown in FIG. 2C). As such, the system will exert a downward force on the user (in the same general direction as the force of gravity) and increase the perceived weight of the user. In running or walking applications, this added weight emulates travel up an incline. Added weight may also increase the impact forces on the user's joints. Both of these characteristics may be beneficial for increasing strength and promoting healthy joints. In addition to creating an enhanced weight during walking or running, this particular application of the system may be used to create additional resistance for exercises such as squats or lunges. More details on the use of the present system for other types of exercises is articulated below.

Figure 7A:
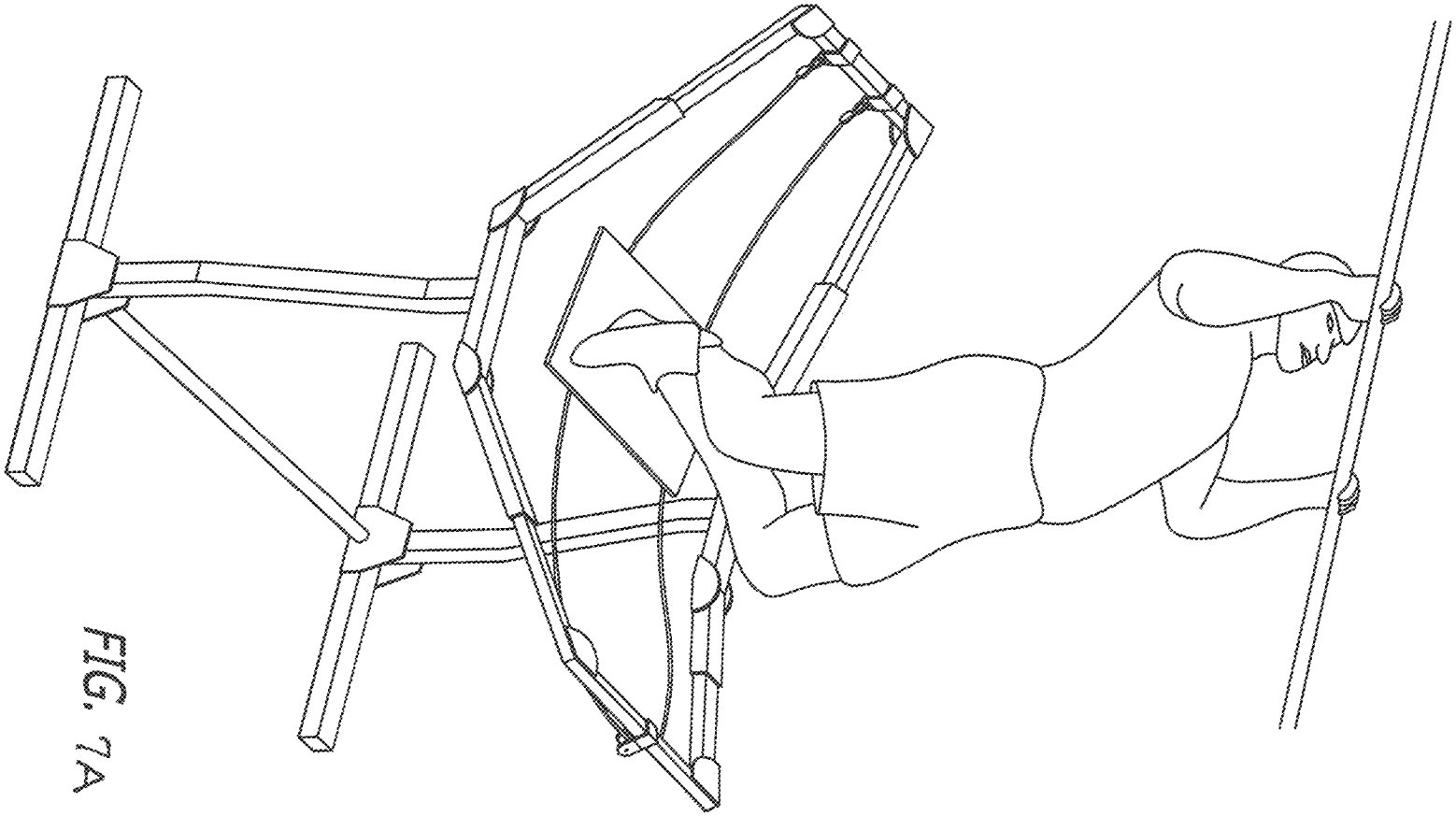
FIG. 7A is an illustration of a user utilizing an embodiment of the present system to perform pullups.
Figure 7B:
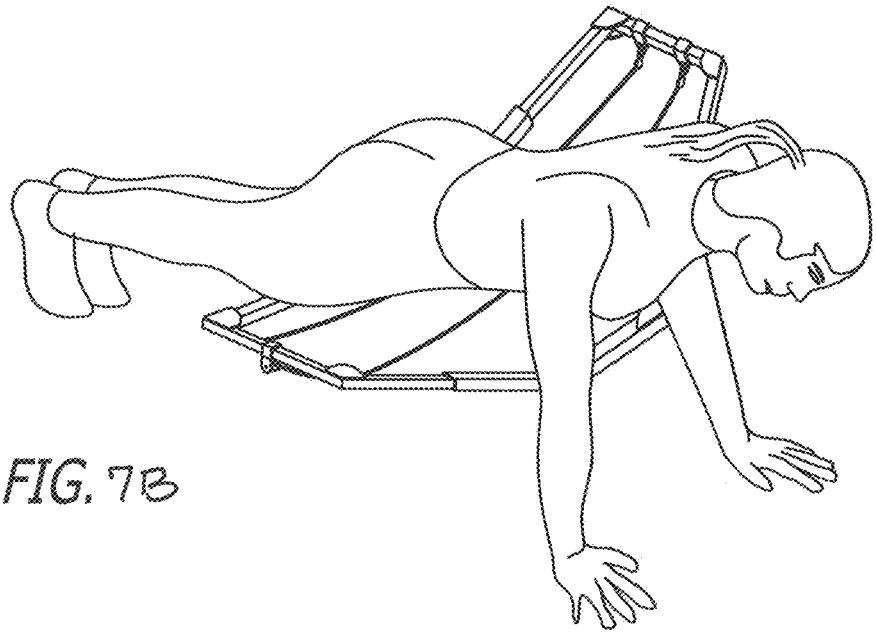
FIG. 7B is an illustration of a user utilizing an embodiment of the present system to perform pushups.

FIGS. 7A-8C show use of the suspension system with exercises other than ambulating on a treadmill. FIG. 7A shows the suspension system providing anti-gravity/effective weight reduction effect to assist in pullups. FIG. 7B shows the suspension system providing anti-gravity/effective weight reduction during exercise pushups. FIG. 7C shows the suspension system providing anti-gravity/effective weight reduction during dips. The suspension mechanism described above, creates a balanced weight reduction, as described above, for other exercises as well.

The present suspension system may be used to assist in a variety of exercises such as squats, lunges, calf raises, dips, planks, pushups, pullups, and the like, both to reduce weight and create an anti-gravity effect and to increase weight to create a pro-gravity affect. As mentioned above, the system may be used to increase weight or resistance in any number of activities such as pull ups, dips, etc. In these applications, the system may be oriented upside down as explained above, for example by being fixed to the floor or to the underside of the dip or pullup bar. The cord then exerts a downward force on the user. In applications, where the system is not used in an upside down orientation, the cord may still be run routed to create a downward force on the user to achieve the same weigh enhancement affect. For example, in applications where shorts and pulleys are used (e.g. FIG. 2A), the cord may be routed over each of the pulleys at the point where the cord is intended to attach to the user.

Figure 8A:
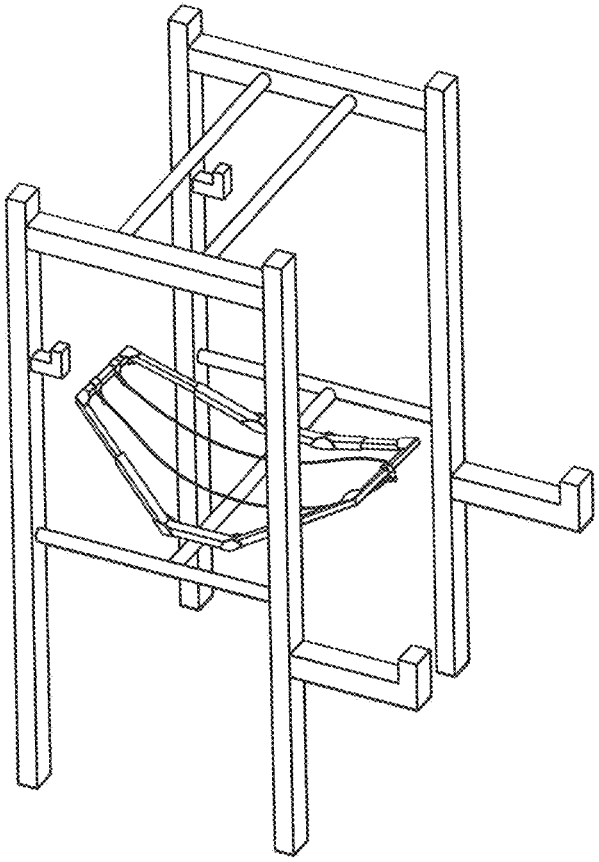
FIG. 8A is an illustration of an embodiment of the present system coupled to one location on a gym rack.
Figure 7C:
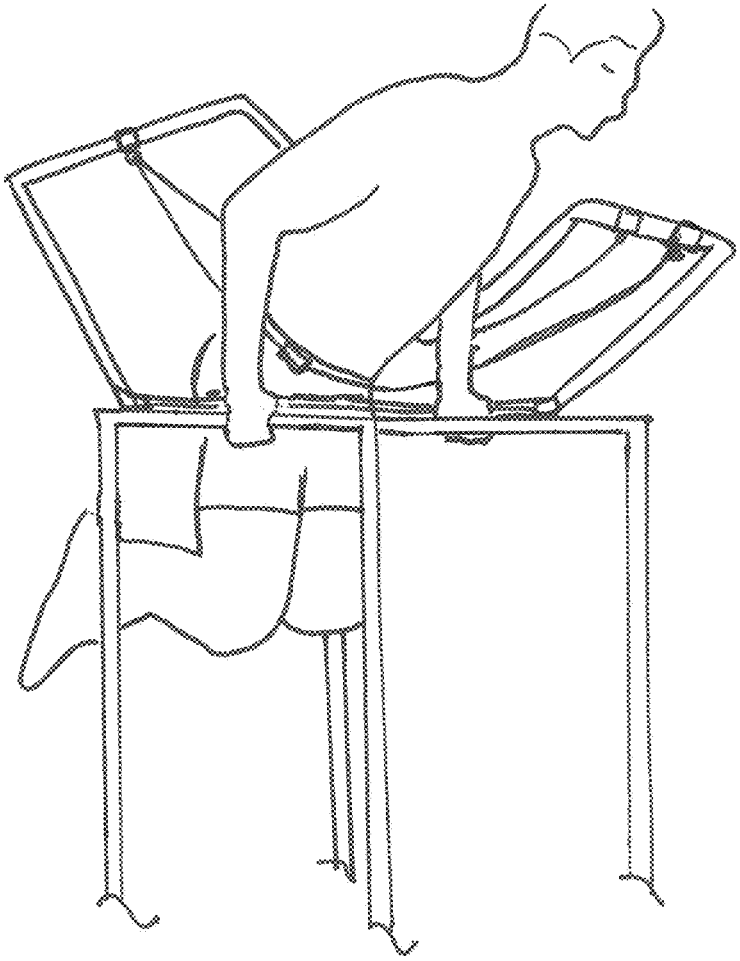
FIG. 7C is an illustration of a user utilizing an embodiment of the present system to perform dips.
Figure 8B:
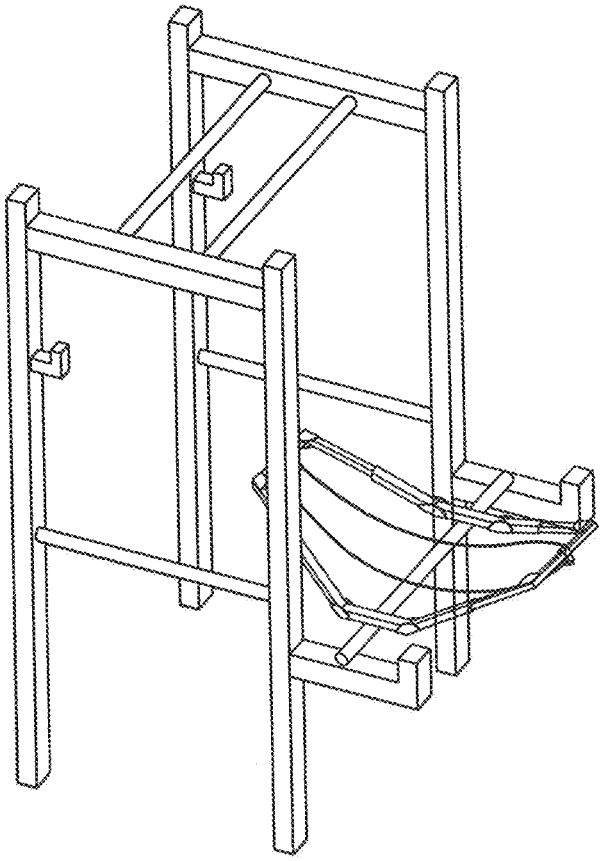
FIG. 8B is an illustration of an embodiment of the present system coupled to another location on a gym rack.
Figure 8C:
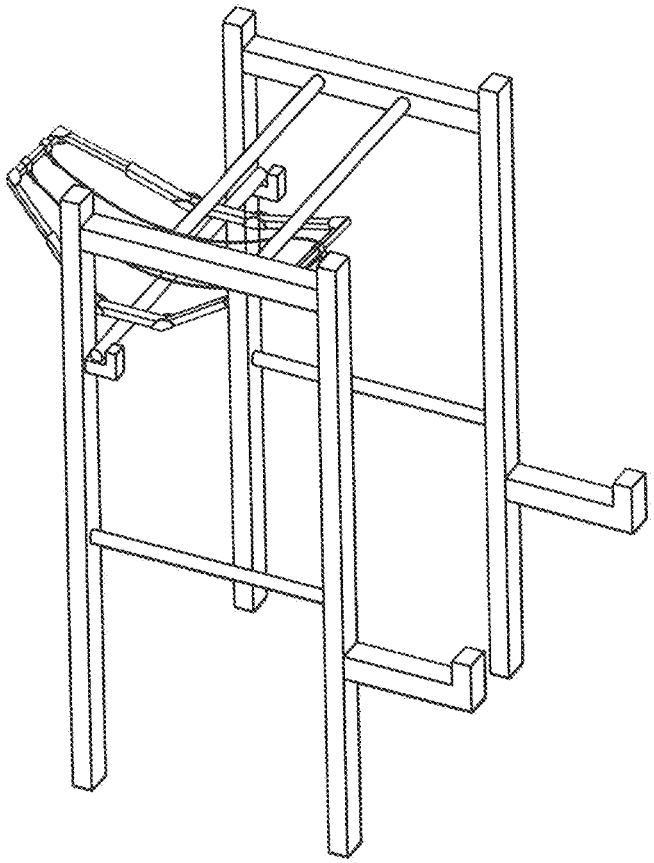
FIG. 8C is an illustration of an embodiment of the present system coupled to yet another location on a gym rack.

In FIGS. 8A-8C the system is shown mounted on a traditional gym rack or weight rack in three different locations. Comparison of the usages shown in FIGS. 8A-8C demonstrate the customizability of the suspension system: the frame assembly of the suspension system may be used in conjunction with equipment in a variety of different ways. Moreover, the system may be raised or lowered, for example in FIG. 8C as compared to FIG. 8B, for additional weight change in a variety of workouts like pullups. In the embodiments of FIGS. 8A-8C, and in similar applications, the frame assembly can be removably mounted with straps, bolts, or other fasteners to the rack, or it may be permanently fixed to the equipment. Alternatively, it may be incorporated into the rack, for example similar to that shown with respect to the treadmill in FIG. 9. Alternatively, it may mounted on a wall or an adjacent structure instead of the equipment. Alternatively, it may be used on a stand. Moreover, any embodiment of the system may be used; for example the integral frame assembly shown in FIG. 2A, the folding frame shown in FIG. 2B, or the telescoping frame shown in FIG. 4, or any of the other versions of the suspension system. That is, the teachings of the suspension system are contemplated as being used with a diversity of devices in a diversity of postures whether permanently configured, temporarily configured, or preconfigured for selective use.

Figure 3:
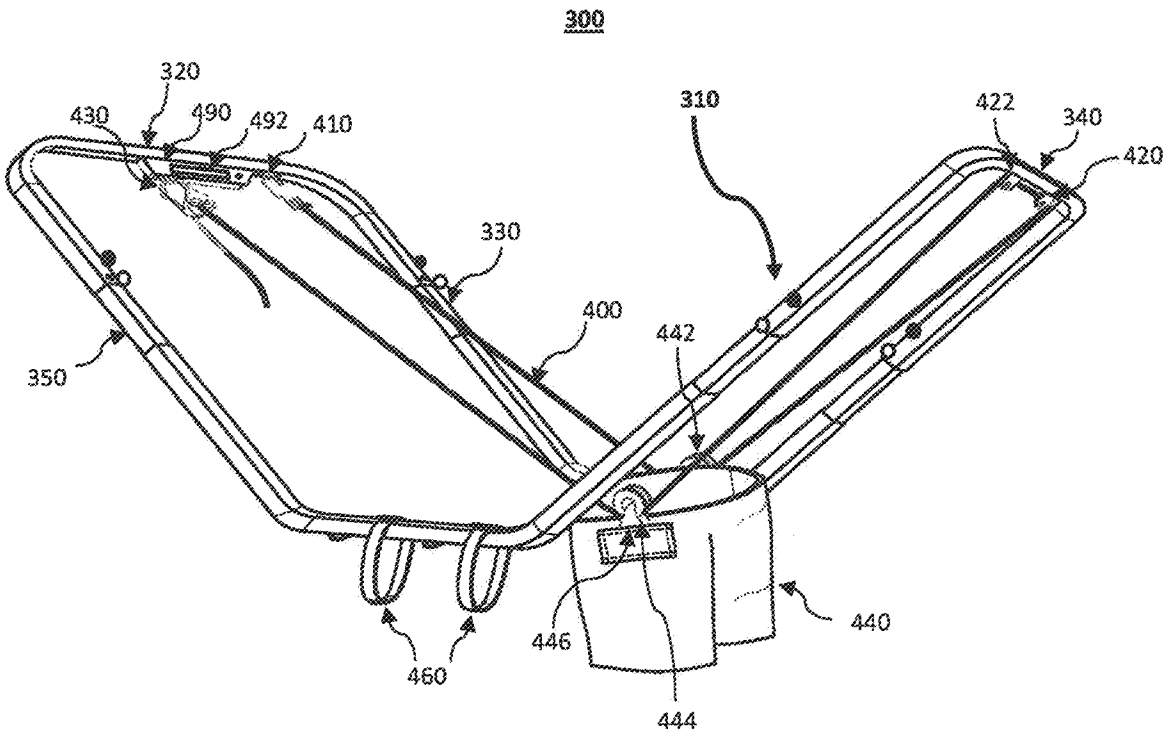
FIG. 3 is an illustrated view of another embodiment of the suspension system.

The system 100 as shown in FIG. 2A has three elastic cord 200 attachment points 210, 220, and 230. The rear cross bar 140 attachment point 220 allows the elastic cord 200 to freely move through the attachment point. Moreover, any number of attachment points may be used; for example two are depicted in FIG. 3. The elastic cord 200 can be attached to the rear cross bar 140 through any of a number of fasteners, such as the ring or eyebolt structure shown in FIG. 2A. Alternatively, the fastener can be a pulley wheel(s) or any other fastener that allows the elastic cord to move freely through the rear attachment point 220. For example, FIG. 2B shows one embodiment of a pulley instead of the eyebolt shown in FIG. 2A. Moreover, the angle of attachment at the attachment point of may vary. For example, in FIG. 2A, an eye bolt which lies in the plane of the rear-extending angled support bars. But as can be seen in FIG. 2B the attachment point may instead by perpendicular to that plane.

The front cross bar 120 attachment points 210 and 230 are equidistant from the center of the front cross bar 120 and securely hold the elastic cord 200 in place during use. Users may move the front attachment points to the very center or to the edges of the front cross bar to accommodate their personal arm swing and personal comfort preferences. The attachment points can also be adjusted to the outside to allow a more locked down running position where they are not able to move side to side as much. This is great for visually impaired runners or runners/walkers with other orientation or instability issues. Moreover, the attachment points may be offset to one side or another to counterbalance the user's physical peculiarity, for example a runner's unique stride such as a limp. Additionally, the force on each segment of the cord may be adjusted slightly by moving the front or rear attachment points away from being in a direct line with the point at which the cord attaches to the user, for example the pulley on the shorts in FIG. 2A. The net addition or reduction of force by the suspension system may be calculated by applying principles of geometry to the force diagram.

One or both of the front cross bar 120 attachment points 210 and 230 may be adjustable with respect to allowing the length of the elastic cord 200 to be adjusted. In this manner, the effective weight change imparted by the system can be adjusted, as well as allowing for the height of the elastic cord 200 to be adjusted within the system to accommodate users of differing heights. Moreover, the adjustable length of the elastic cord 200 allows for a continuous adjustment of height that is not limited by fixed points of height adjustment, as typically used in other systems. Moreover, any number of attachment points can be used so long as ends of the elastic cord are secured on the front cross bar. Additionally, a variety of attachment mechanisms can be used such as eyebolts, pulleys, cams, or other fasteners.

As shown in the system 100 in FIG. 2A, the front cross bar 120 attachment points for the elastic cord 200 include a fixed attachment point 210 and an adjustable attachment point 230. The adjustable attachment point 230 allows the length of the elastic cord 200 to be adjusted at one end while the fixed attachment point 210 holds the other end in one place. The placement of the adjustable attachment point is arbitrary, such that either attachment point 210 or 230 could be an adjustable attachment point while the other attachment point is fixed. In an alternative embodiment, both front cross bar attachment points can be adjustable to allow adjustment of the elastic cord from both sides of the front cross bar. The angle of attachment of the front attachment points can likewise vary in the same manner as describe above with respect to the rear attachment point.

Throughout this specification, the system is referred to as having an orientation of front and rear. It is to be understood that this orientation is provided as such out of convenience, and it not limited to such an orientation. Accordingly, the adjustable fastener(s) could be attached to the rear of the frame assembly, and the fastener(s) that allow the elastic cord to move freely could attach to the front of the frame assembly.

Figure 12:
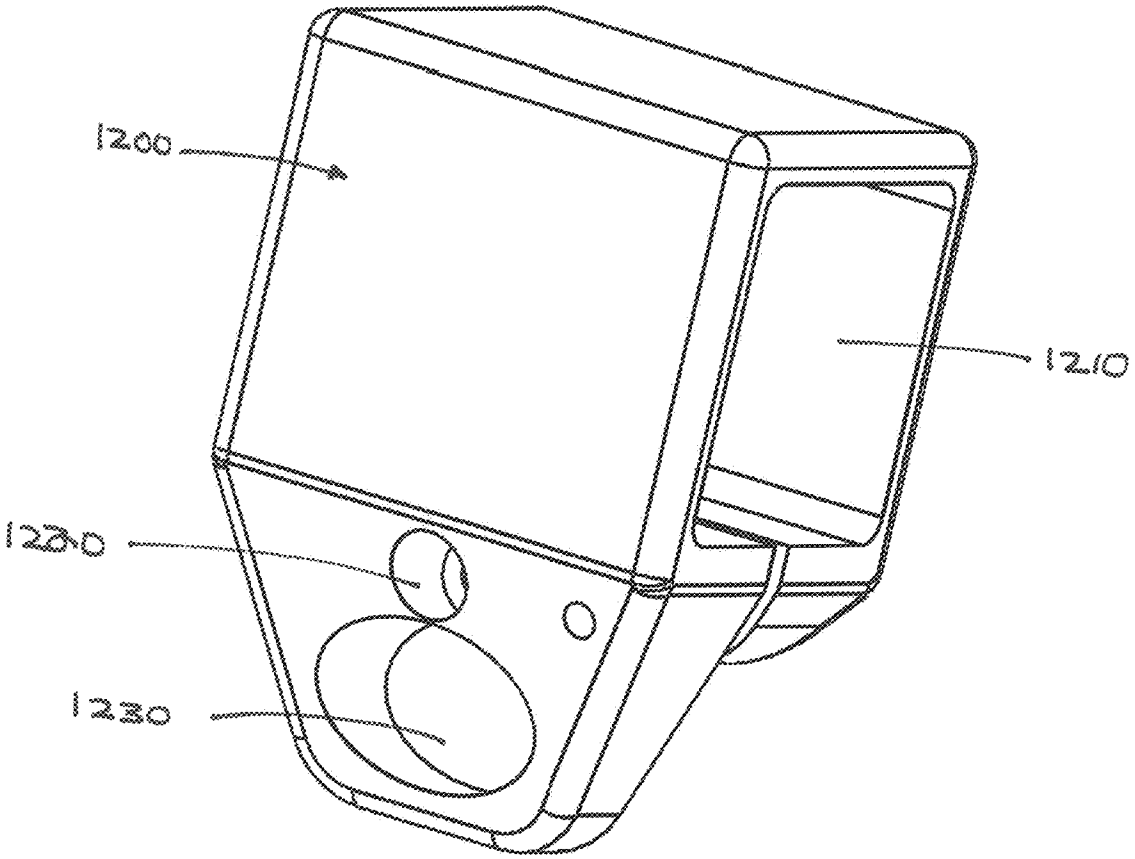
FIG. 12 is an illustration of an embodiment of an adjustable attachment point.
Figure 13:
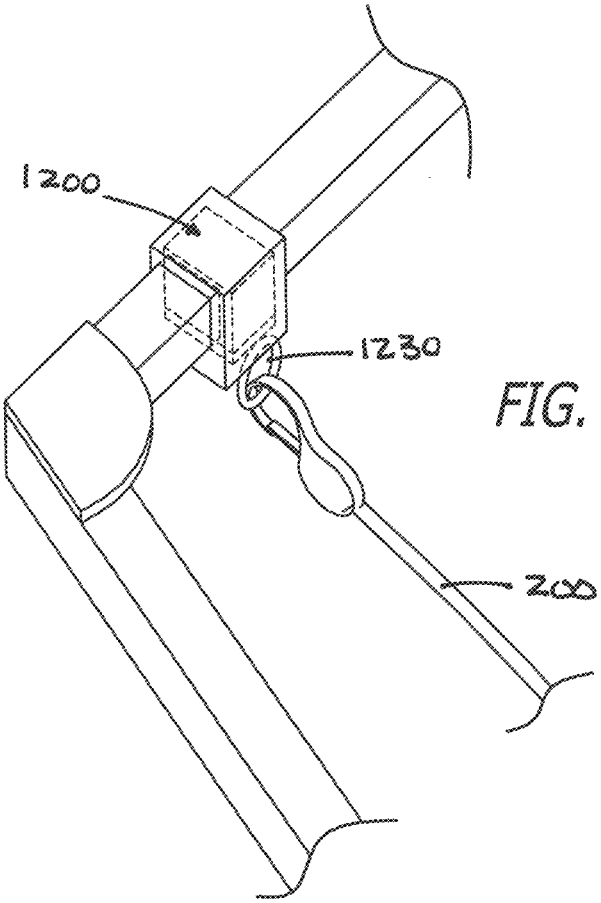
FIG. 13 is an illustration of an adjustable attachment point used as the front attachment point.
Figure 14:
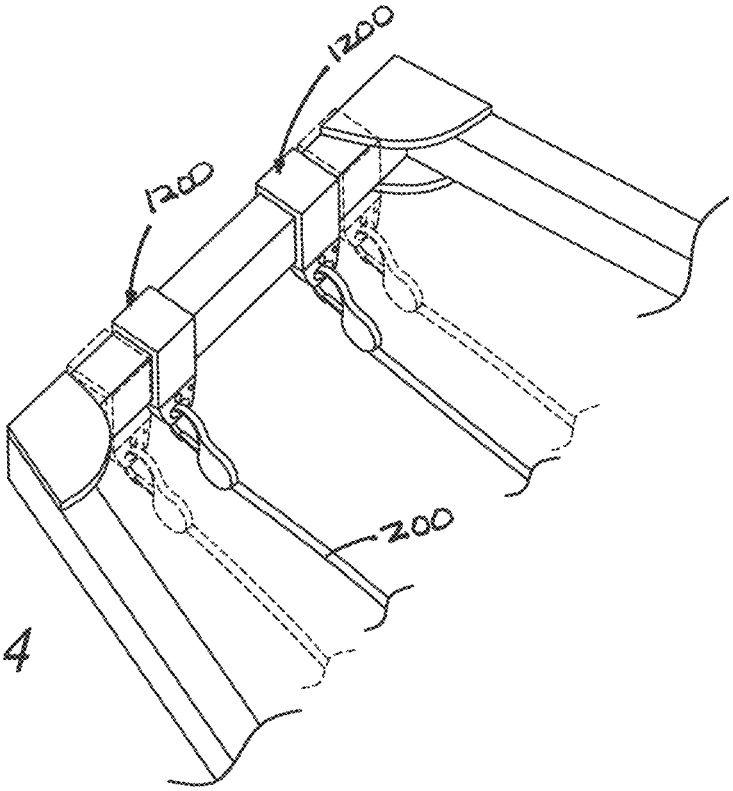
FIG. 14 is an illustration showing two adjustable attachment points coupled to the cord.
Figure 19:
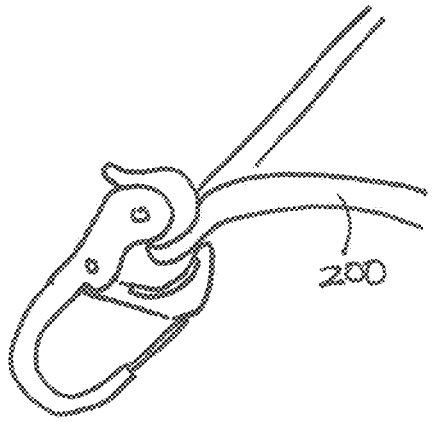
FIG. 19 is an illustration of an embodiment of a cam which may couple the cord to an attachment point on the frame assembly.

The elastic cord 200 can be attached to the frame 110 through any of a number of attachment fasteners or mechanisms. For example, the rear cross bar 140 attachment point 220 can be an eye bolt (FIG. 2A), a pulley wheel(s) (FIG. 2B), or any other attachment mechanism that allows the elastic cord to freely move at the rear of the suspension system 100. The front cross bar 120 can include a fixed attachment point at one of the two attachment points for attachment of one end of the elastic cord 200. The stationary attachment of the elastic cord can occur through a hook through an eyebolt as shown in attachment point 210, or any alternative type of fastener that will hold an end of the elastic cord in place. One or both ends of the elastic cord 200 can be attached to the frame 110 by an adjustable fastener. For example, a rope cam 230 as shown in FIG. 2A (or FIG. 19) can be used an adjustable fastener. Alternative fasteners that allow for the length of an end of the elastic cord 200 to be adjusted can likewise be employed as an adjustable fastener. For example, a winch, a one-way bearing wheel, a ratcheting device, and so forth could be employed as an adjustable fastener. Although the elastic cord is illustrated as engaging attachment points on cross bars that are horizontal, it is to be understood that the elastic cord also can engage attachment points on cross bars that are vertical in orientation FIG. 12 shows one embodiment of an adjustable attachment point. The attachment member 1200 includes a casing 1210 which fits over the cross bar to which it couples. FIG. 13 shows this member coupled to the front crossbar of a frame assembly. The fastener 1200 also includes a tightening mechanism 1220. In FIG. 12, the tightening mechanism in a screw which fits into the opening in the member 1200 at 1220. Tightening the screw the casing on the cross bar and loosening the screw loosens the casing, allowing it to move on the cross bar or be altogether removed. The member 1200 also includes a cord attachment opening 1230. FIG. 13 shows cord 200 coupled to the cord attachment opening 1230. In this illustration, a removable clip is illustrated. But as mentioned above, any type of coupler may be used. In particular, the coupler may be releasably attached to the cord to allow for the changing of the length of the cord. Moreover, as noted above, where tensioning the cord is desired, cams or other tensioning mechanisms can be used to couple the cord to the attachment point, including to the embodiment of the attachment point shown in FIG. 12. FIG. 19 shows a cam which may be releasably coupled to the attachment member and tension the cord. FIG. 14 shows members 1200 coupled to a cord 200.

Figure 16:
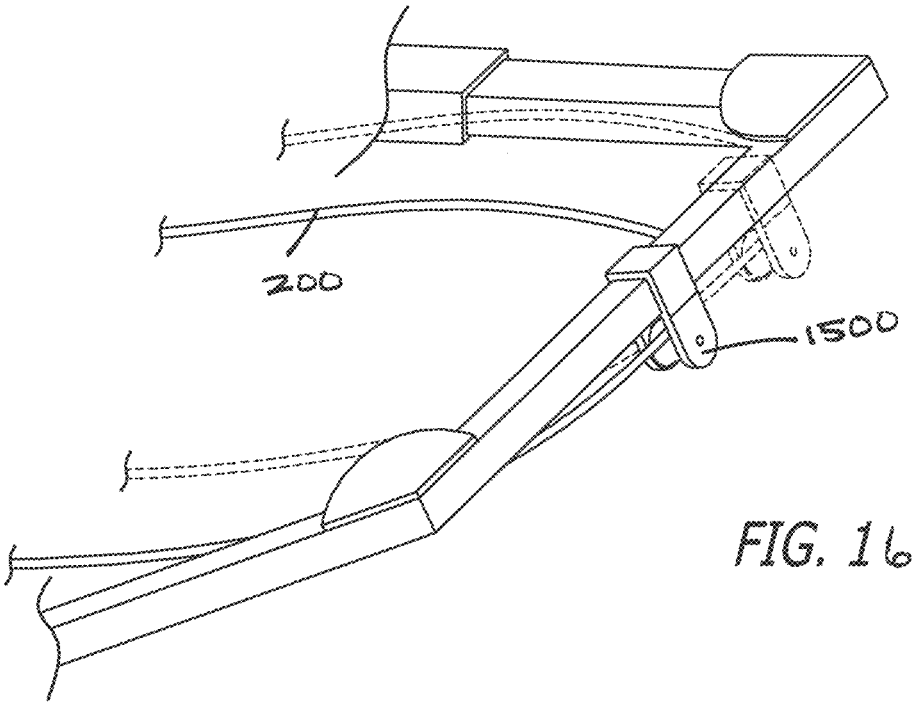
FIG. 16 is an illustration of a pulley attachment used as a rear attachment point.
Figure 15:
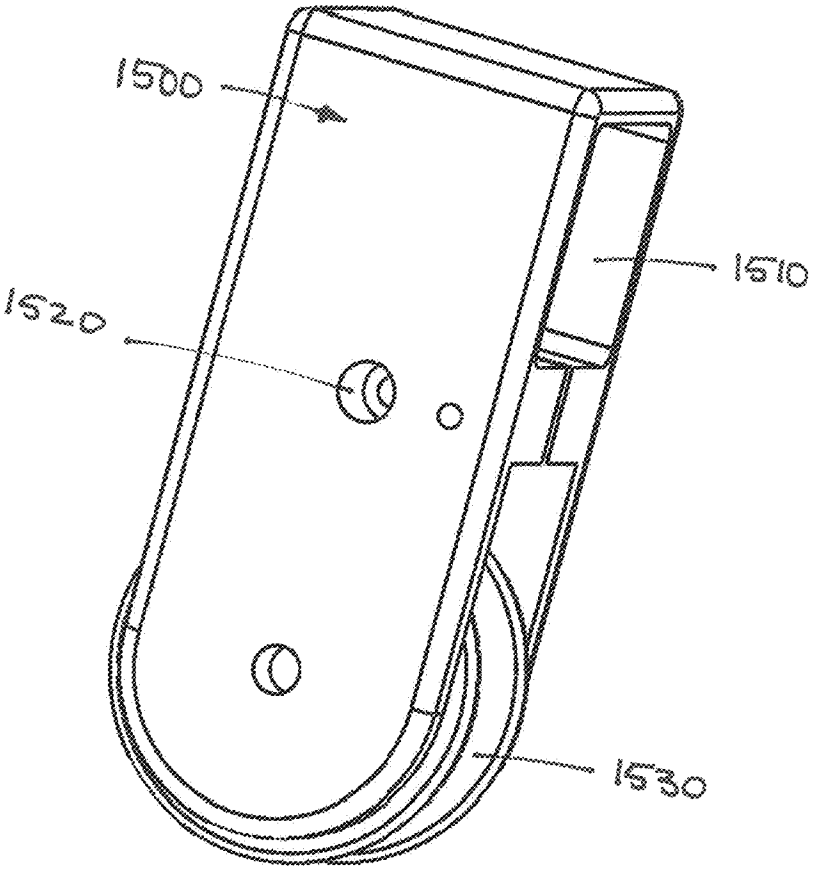
FIG. 15 is an illustration of an adjustable pulley attachment.

FIG. 15 shows another embodiment of an attachment point. Attachment member 1500 includes a casing 1510 which fits over the crossbar, as explained above with respect to element 1210 in FIG. 12. Member 1500 also includes a tightening mechanism 1520 which in this embodiment is a screw such as that explained with respect to FIG. 12. Member 1500 additionally includes a pulley 1530 which may couple to the cord 200. FIG. 16 shows the member 1500 coupled to the cord 200 through pulley 1530.

For quantitative analysis or to generate evaluation metrics, measuring the load on suspension system may be desirable. For example, a load cell positioned between the elastic cord 200 and attachment point 230 (FIG. 2A) will measure the load on the elastic cord. This measured load is proportional to the weight change created by the suspension system. This and other related information may be measured and displayed to a user.

Figure 17:
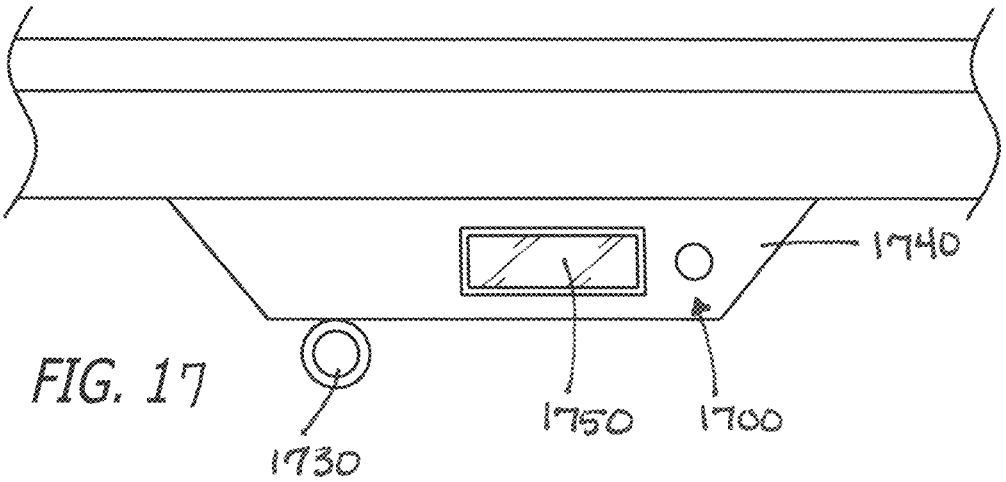
FIG. 17 is an illustration of an embodiment of an attachment member with enhanced functionality including a display screen.
Figure 18:
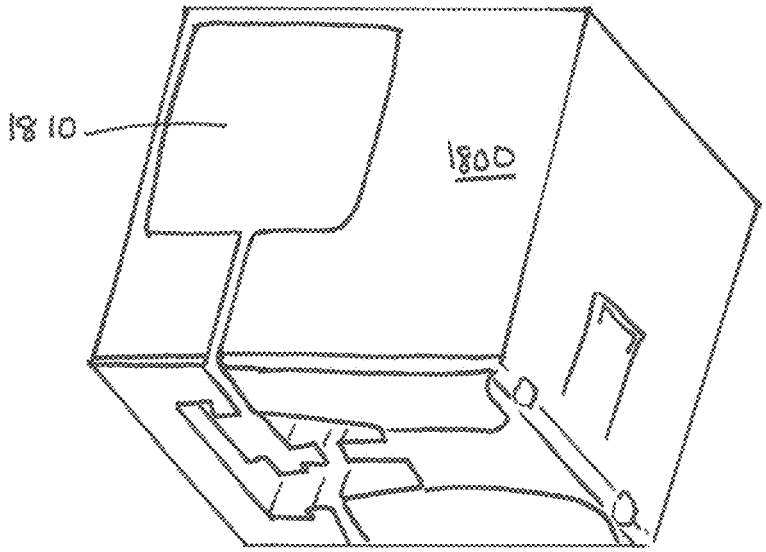
FIG. 18 is an illustration of another embodiment of an attachment member with enhanced functionality.

FIGS. 17 and 18 show embodiments of the attachment member which includes enhanced functionality. FIG. 17 illustrates an attachment member 1700 including a display screen 1750. Member 1700 includes a housing 1740 which may include electronics for processing information and providing an output to a user. The output may be displayed on display screen 1750 which is incorporated into the housing 1740. The member also includes cord attachment opening 1730 which may couple to cord 200 (not shown). The functionality of display screen 1750 may be similar to that described below with respect to monitor 490 in FIG. 3.

FIG. 18 shows yet another embodiment of an attachment member 1800 with a casing 1810. Casing 1810 may be used as an attachment point similar to that described with respect to casing 1210 in FIG. 12. Casing 1210 houses a sensor (for example a load cell) and associated circuitry (for example a circuit board). The sensor measures data and takes readings which it may then transmit to a main processing unit. For example, the sensor may measure a load and transmit that information wirelessly, e.g. via Bluetooth, to an app on the user's smart phone or smart watch. Any known sensor and any known transmission and processing methods may be used without limitation. In one embodiment, the sensor may be a micro load cell GML699 sold at https://galoce.en.alibaba.com/product/60705152065-802747558/GML699. In another embodiment, the sensor may be a full bridge 40 kg micro load cell.

As noted above, many types of attachment members, fasteners, and couplers are contemplated to connect the cord to the frame assembly. Selection of the particular one depends on the desired configuration as relates to the ease of placement, adjustability, tension on the cord, and the like. Moreover, attachment members may include enhanced functions including load measurement, processing, and display of information. Any of the attachment members may be used for the front or the rear.

In operation, in the embodiment of FIG. 2A, elastic cord 200 attaches to the front cross bar 120 at an attachment point 210 where there is an attachment fastener. The elastic cord then passes through a pulley wheel 242, next threads and passes through a rear attachment point 220, then passes through a pulley wheel 244, and finally passes through the front attachment point 230 where there is an adjustable fastener. A user attaches to the elastic cord 200 indirectly through the pulleys 242 and 244. The pulley wheels 242 and 244 attach to the user by a configuration in which the pulley wheels 242 and 244 can be permanently attached to the user's leg garment 240 such as by support straps 246 as shown in FIG. 2A. Alternatively, the pulley wheels 242 and 244 can be attached to the user's shorts 240 by other fastener supports or support straps that are removably attached to the shorts 240 by a hook and loop fastener, buttons, snaps, zippers, and the like. The user's pants or shorts 240 are to be put on by the user prior to use of the system 100.

The pulley wheels 242 and 244 allow a user to freely move while using the system 100. The pulley wheels 242 and 244 can rotate back and forth over the elastic cord 200 to allow the user to move freely with a natural back and forth and up and down movement. The flexibility of the elastic cord 200 coupled with the free rotation of the pulley wheel 242 and 244 also allows for freedom of motion from side to side as naturally occurs when a person walks or run. The equalization of upward lifting force throughout the system 100 coupled with the freedom of movement of the elastic cord 200 relative to the pulley wheels 242 and 244 as well as relative to the rear attachment point(s) allows a user to freely move within the system 100. While pulley wheels are an example of an attachment means which permits movement of the elastic cord with respect to the shorts 240, any other fastener which permits free movement of the cord may be used. For example, a ring, tube, or opening coupled with the shorts through which the elastic cord can freely slide may be used instead of a wheel.

When using the present system with a treadmill, the user's weight is supported by the shorts. Shorts are also useful when using the present system to perform dips. Other apparel that are capable of supporting the weight of the user may be used instead of the traditional shorts shown in FIG. 1 such as tights, strap or harness system to be worn over clothing, or thigh straps.

In other applications, the user may not assume an upright position with respect to system 100 and thus other means of supporting the weight of the user are contemplated. For example, the user may weight the elastic cord directly with no intervening apparel (e.g. FIG. 7B). Alternatively, a platform or deck can be coupled to the cord which supports the user's weight (e.g. FIG. 7A). In these and similar applications, the back and forth movement of the elastic cord through rear attachment point may sometimes be reduced as compared with running or walking. Nevertheless, the elastic nature of the cord will still act to counterbalance the weight of the user and provide an upward (or downward) force which achieves the objects of the present disclosure. In these applications, the rear attachment points may be replaced with a ring, tube, or opening coupler, a cam, or tensioner. Any number of attachment points, including one or more of the front attachment points, may be similarly replaced As shown in FIG. 1, the system 100 can be attached to a treadmill 700 by resting the frame 110 on the arms 720 and 740 of a treadmill. In particular, the horizontal base portion of each of the base/supports 130 and 150 of the frame 110 rests on the arms 720 and 740. The frame is then secured in place by straps 260 that wrap around the arms 720 and 740 of the treadmill 700 (the straps that would wrap around arm 740 are not shown). The straps 260 can be securely closed and fastened around the arms 720 and 740 of the treadmill 700 by any of a number of non-limiting fasteners, such as straps with holes that feed through a buckle, snaps, hook and loop fasteners, and so forth. The straps 260 themselves can be made of any of a number of materials such as, but not limited to, rubber, nylon, and other materials that impart the strength, flexibility, and durability required for the straps 260 to securely hold the system 100 to the treadmill 700. The stability of the frame 110 on the arms 720 and 740 of the treadmill is further enhanced by flat bars 262 that are perpendicular to the base/angled support bars 130 and 150 so as to provide additional, flat surface area of the frame 110 relative to the arms 720 and 740 of the treadmill 700.

In one embodiment of ambulating applications in combination with a treadmill, for example as in described in FIGS. 1 and 2A-B, after a user puts on shorts 240 and is positioned and ready to use the system 100 on the treadmill, the user threads the elastic cord 130 (which is attached to first front attachment point 210) through the first pulley wheel 242, through the rear attachment point 220, through the second pulley wheel 244, and through the second front attachment point 230. This process ties the user's shorts 240 into the system 100 system. Once the user is ready to begin a workout on the treadmill, the user tightens the elastic cord 200 using the rope cam system at front attachment point 230 to a desired tautness and is provided a lifting force such that the user has an effective weight reduction, anti-gravity suspension while workout on the treadmill.

After the user has completed his workout, the user releases the tautness of the elastic cord 200 and is then able to release the elastic cord 200 from the second front attachment point 230, second pulley wheel 244, rear attachment point 220, and first pulley wheel 242 to release the user's shorts 240 from the system, thereby releasing the user from the system 100. The suspension system works similarly when used for other exercises and in combination with other equipment.

Turning now to FIG. 3, an illustrated view of another embodiment of a suspension system 300 is presented. This embodiment is primarily the same as that shown in FIG. 2A, with one difference being in the configuration of the elastic cord's attachment to the rear cross bar. As shown in FIG. 3, this embodiment has two pulley wheels 420 and 422 as points of attachment on the rear cross bar 340. The pulley wheels allow the elastic cord to freely travel from side to side. As noted before, any other attachment member which allows free movement of the cord can used as the rear attachment point including eyebolts, pulleys, or other fasteners.

As shown in FIG. 3, an elastic cord 400 attaches to the front cross bar 320 at an attachment point 410 where there is an attachment fastener. The elastic cord then passes through a first pulley wheel 442, next passes through a first rear fastener 420 at a first rear attachment point on the rear cross bar 340, then passes through second rear fastener 422 at a second rear attachment point on the rear cross bar, then passes under second pulley wheel 444, and finally passes through the front cross bar 320 attachment point 430 where there is an adjustable fastener for adjusting the length of the elastic cord.

The attachment points shown in FIGS. 3 and 2A are shown as being in fixed locations on the front and rear cross bars. The locations provide for the elastic cord to be located such that the embodiments of the suspension systems in FIGS. 2A and 3 will accommodate users of varying statures, including differing body width sizes.

In an alternative embodiment, the attachment points are not at fixed locations on the front and/or rear cross bars, but rather at adjustable locations, such that the attachment points can be moved in or out relative to the cross bars. In the embodiment shown in FIG. 2A, the front attachment points/fasteners 210 and 230 could be adjustable with respect to the front cross bar 120, such that they can move from side to side on the front cross bar 120. In the embodiment shown in FIG. 3, the front attachment points/fasteners 410 and 430 could be adjustable with respect to the front cross bar 320, and/or the rear attachment points/fasteners 420 and 422 could be adjustable such that they move from side to side on the rear cross bar 340. Accordingly, either the front 410, 430 or rear 420, 422 attachment points could be adjustable from side to side, or both the front 410, 430 and rear 420, 422 attachment points could be adjustable. In this regard, the width of the elastic cord can be adjusted from narrower to wider. Accordingly, as the adjustable attachment points are moved in on the cross bars, the width of the elastic cord will be narrower, and as they are moved out, the width of the elastic cord will be wider. In this manner, the suspension system can have additional flexibility to accommodate a variety of sizes of users and varying distances between different users' hips.

The system 300 further differs from that shown in FIG. 2A in that it further includes an optional monitor 490. It is to be understood that an optional monitor also may be used with the embodiment shown in FIG. 2A and the other embodiments disclosed herein. The monitor 490 provides a number of functions, which includes showing the effective weight change of the system 300. The monitor 490 has a display 492 that displays information from the monitor 490 to a user of the system 300. As the tension on the elastic cord 400 is increased through the fastener 430 with the adjustable rope cam, the effective amount of weight change is increased and shown on the monitor 490. Likewise, as the tension on the elastic cord 400 is decreased, the effective amount of weight change is decreased and shown on the monitor 490. For example, tensioning the elastic cord 400 might increase the effective weight reduction from zero to 10% weight reduced (90% of body weight) which would be shown on the monitor, while releasing tension on the elastic cord 400 could conversely reduce the effective weight reduction from 10% weight reduced to zero lbs., which likewise would be displayed on the monitor.

In one embodiment, a user can enter his or her actual weight into the monitor, and the monitor can display their effective reduced weight and or percentage of body weight reduction. For example, if a user enters 200 lbs. and experiences an effective weight loss of 20 lbs., the monitor could display an effective weight of 180 lbs.

In addition to displaying the amount of effective weight change, the monitor 490 may have functions to monitor other aspects of use of the system 300, such as speed of the treadmill, distance traveled, the user's cadence, number of steps taken, and so forth. The monitor may include circuitry, microprocessors, etc. that allow a number of aspects of use of the treadmill to be tracked for a user. The monitor may incorporate functionality that allows tracking of a user's performance through wired or wireless sensors attached to the runner or detected by the monitor. These and other enhanced functions may be incorporated into the monitor, into another on-board processing unit, or into the attachment points. Moreover, the sensors necessary to measure and provide the data used in these enhanced functions may be incorporated into various locations in the system.

The monitor may communicate with other devices such as a computer, phone, wearable accessory, and the like to perform one or more of the enhanced functions described above. For example, a load cell sensor may collect data related to the tension of the cord during use. The sensor may communicate with a circuit board, which may for example include a processor and a transmitter, incorporated into the attachment point (or the monitor) which processes the data and calculate a weight change percentage. The circuit board may then transmit the calculated change to the monitor or remotely to a central processing unit or to an app which then displays the information on the user's smartphone or his wearable electronics. As is readily recognized by those of ordinary skill, these enhanced functions may include a variety of information including cadence, workout time, type of exercise, total time in use, calories used, vital signs, training and exercise plans, physical fitness goal displays, etc. Moreover, if an electronic winch is incorporated into the cord attachment points, (as more fully explained below), the enhanced functions may enable adjustment of the tension of the cord, and thus adjustment of the weight change, remotely or even automatically through a an algorithm incorporated into the enhanced functionality. For example, the training plan may call for an increase in intensity, at which time, the algorithm communicates with the electronic winch to loosen the tension (e.g. for someone doing dips) and increase the intensity of the exercise by forcing the user to experience more weight.

The enhanced functions may be implemented in a combination of hardware, software, firmware, locally, or remotely, wired or wirelessly, according to known technologies. They may be performed in the monitor (e.g., monitor 490 or FIG. 17), in processors embedded in the attachment member (e.g. FIG. 18), or in remote software such as through a website or an app. In one embodiment, an app interfaces with the user and enables the enhanced functionality. Other embodiments include processors incorporated in other portions of the system 100 or in the equipment to which they couple, for example the treadmill or the weight rack.

A user interface may be configured to receive or display data to the user to achieve the enhanced functionality. For example, a user may download an app on his phone which communicates with the suspension system. A few examples of various configurations of graphical user interfaces for such an app are shown in FIGS. 28-32.

In one embodiment, a user may utilize the app by entering his weight, say 200 lbs. The app may receive information from sensors (e.g. FIG. 18) incorporated into suspension system and calculate the effective weight of the user. The app may display this information to the user. Moreover, the app could be configured to receive and transmit a wide range of information from and to the user to enable various aspects of the enhanced functionality.

In another embodiment, the user may enter its desired effective weight or a weight reduction (or increase) factor into the app. The app can then calculate the tension required on the cord to achieve the desired lift or downward force.

The app may transmit this information to an electronic or micromechanical device which tensions the cord.

Figure 4:
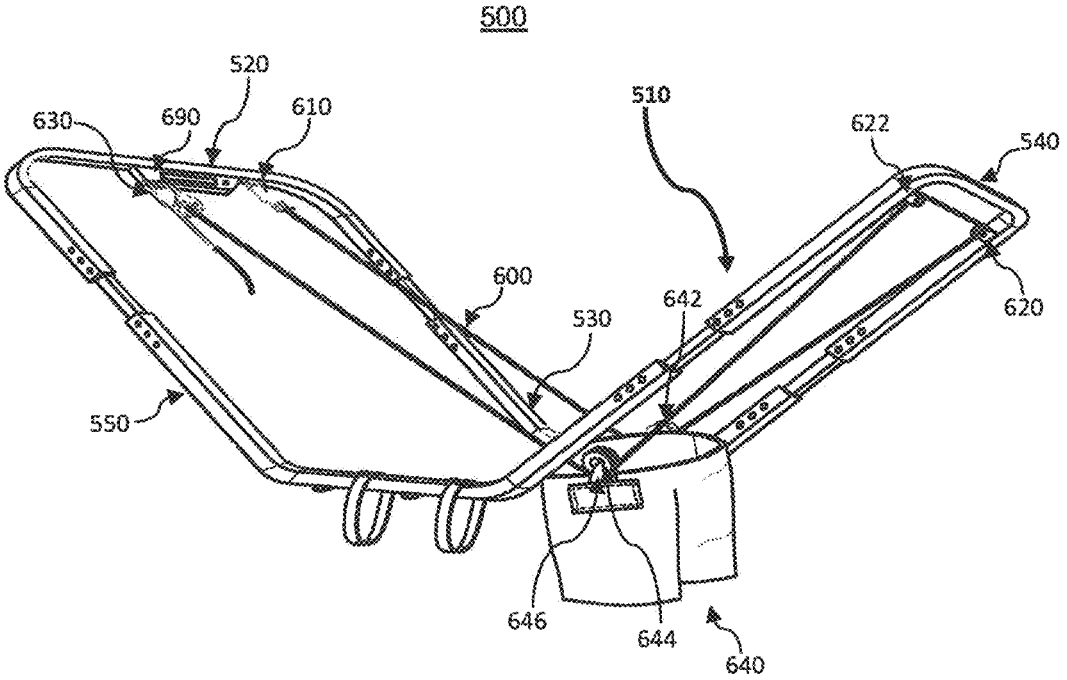
FIG. 4 is an illustrated view of another embodiment of the suspension system.

Turning now to FIG. 4, this figure depicts yet another embodiment of the presented system. This embodiment is essentially the same as system 300 shown in FIG. 3, but the location of the rear pulley wheels 620, 622, to which the elastic cord is fastened to the rear of the system 500 shown in FIG. 4 is different. In system 300 shown in FIG. 3, the rear pulley wheels 420 and 422 are mounted on the horizontal portion of rear cross bar 340. In comparison, the rear pulley wheels 620 and 622 in system 500 shown in FIG. 4 are mounted on the vertical, angled support bars 530 and 550 rather than on the horizontal cross bar 540. Accordingly, the pulley wheels at points 620 and 622 represent an alternative configuration of the rear pulley wheels on the vertical, angled support bars rather than on the rear cross bar. In this alternative configuration the rear pulley wheels continue to allow the elastic cord to freely move and travel from side to side, and the configuration provides for a placement of the rear pulley wheels that accommodates a range of user body/distance between hips widths.

Figure 20:
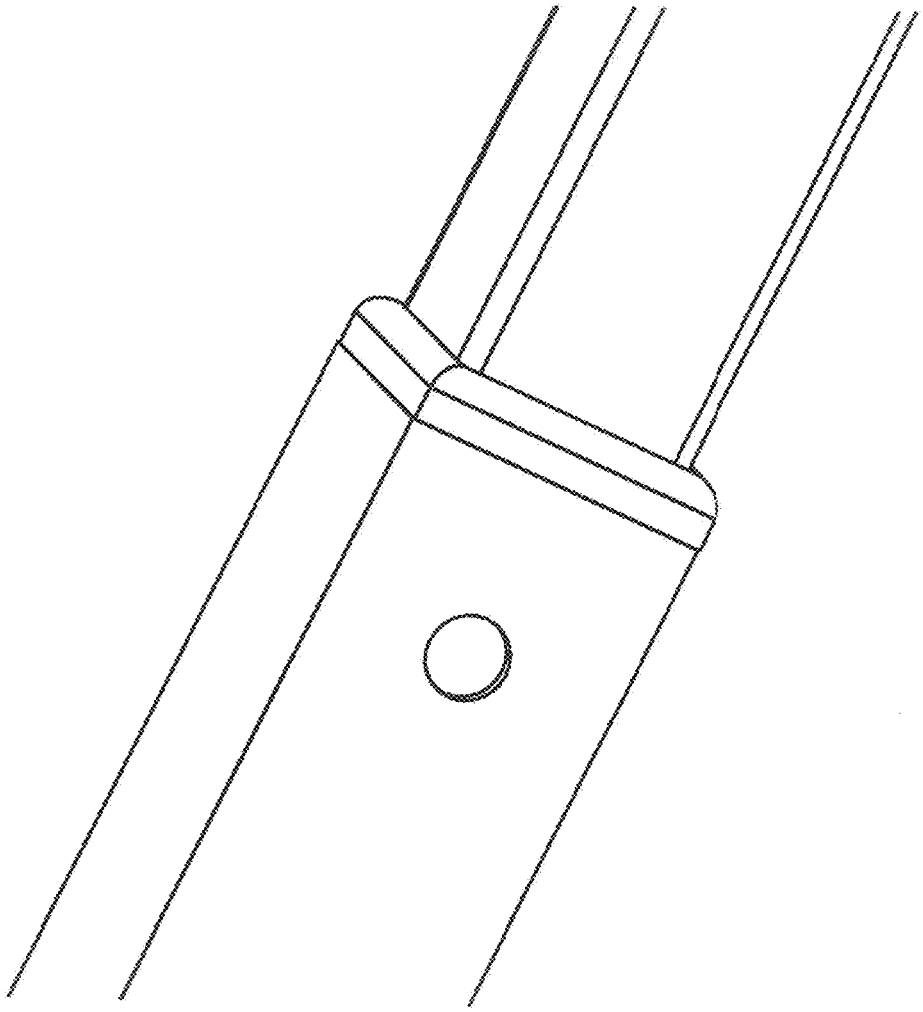
FIG. 20 is enlarged view of a push-button telescoping mechanism.

The suspension system 500 shown in FIG. 4 is shown with a frame assembly having telescoping angled support bars 530 and 550 that can be adjusted to different heights. In this manner, the system 500 has flexibility with respect to height adjustment of the frame 510 to allow greater variability with respect to treadmills having mounting arms of different heights. The telescoping bars function by sliding in and out and locking in place at the desired location to adjust the height. The embodiment of FIG. 4 shows the locking mechanism to be the push-button mechanism known in the art. Other mechanisms may also be used including clamps, set screws, compression rings, or compression locking mechanisms where the outside or inside tube is deformed and compress the other tube securing it in place. FIG. 20 is an enlarged illustration of a push-pin telescoping joint.

In addition to telescoping bars, the frame assembly may be folded for convenient transport. Moreover, foldability allows the device to be resized for a space having different geometry. Additionally, folding permits a change in angle of the side base and angled support arm bars with respect to the horizontal plane or the horizontal base bar. Different angles create different force geometries which affect the lift (or downward force) provided by the cord with respect to the user.

Each of the features of integral formation of the frame assembly, telescoping capabilities, or folding capabilities are independent benefits and may be incorporated with or without each other in any given embodiment of the frame assembly. For example, the embodiment of FIG. 3 shows only a telescoping capability, whereas the embodiment of FIG. 2B shows telescoping and foldability.

Returning now to FIG. 2B, an illustrated embodiment of the frame assembly 110' is shown which is foldable. Frame assembly 110' includes two (2) side base and angled support arm bars 130', 150', and two (2) cross bars, a first or front bar 120', and a second or rear bar 140'. Like parts are numbered with similar number in FIGS. 2A and 2B. At the end of bar 120', joints 1000 and 1001 enable folding of the bar with respect to the support arm bars 130' and 150'. Similarly, joints 1002 and 1003 enable the folding of bar 140. The different sections of support arm bars 130' and 150' may also fold using the joints 1005-1008.

Figure 10:
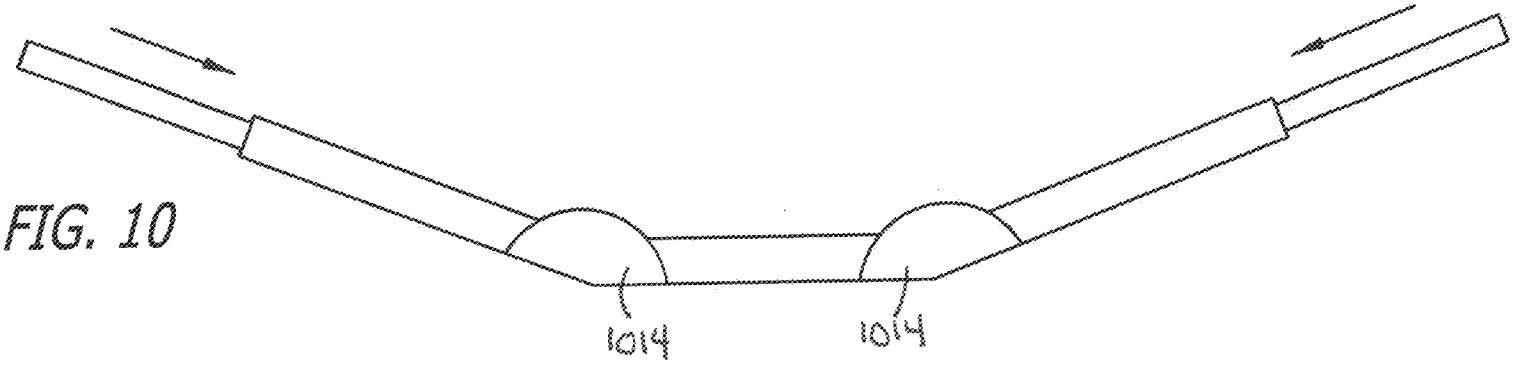
FIGS. 10 and 11 are illustrations showing the arms of a frame assembly folding.
Figure 11:
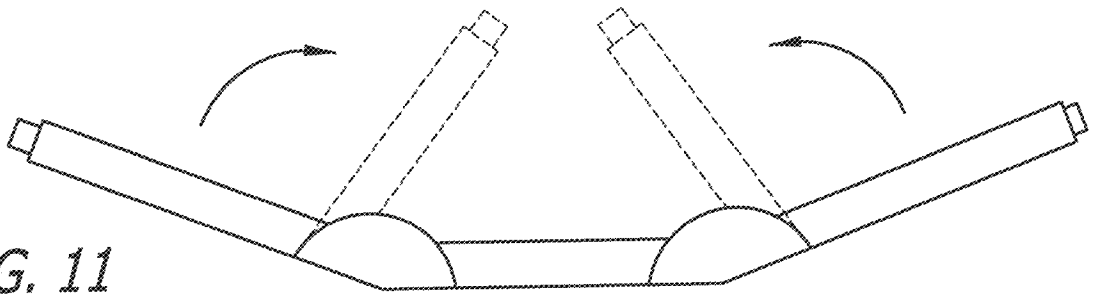
Figure 21:
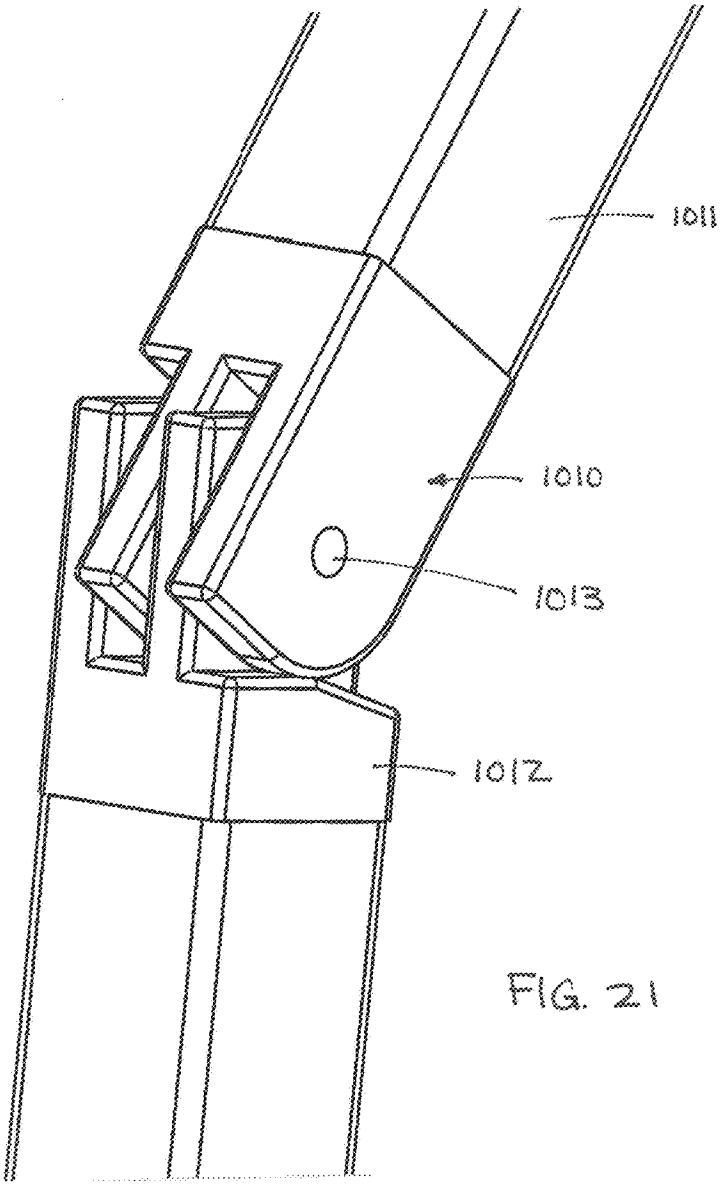
FIG. 21 is an illustration of an embodiment of a folding joint.

One embodiment of a folding is a rotating simple joint such as a hinge, an example of which is shown in FIG. 21. The two bars 1011 and 1012 on either side of the joint 1010 fold onto each other as the joint is pivoted around the central pin 1013. Other folding joint known in art may also be used to affect the joints 1000-1008. Moreover, each support arm bar or cross bar may be formed with more segments than that shown in FIG. 2B, each including a folding joint. Such an embodiment would be capable of folding into a smaller footprint. FIGS. 10-11 show the bending motion at the articulated joints which permit folding. Guard 1014 covers the joint in FIG. 10.

Figure 22:
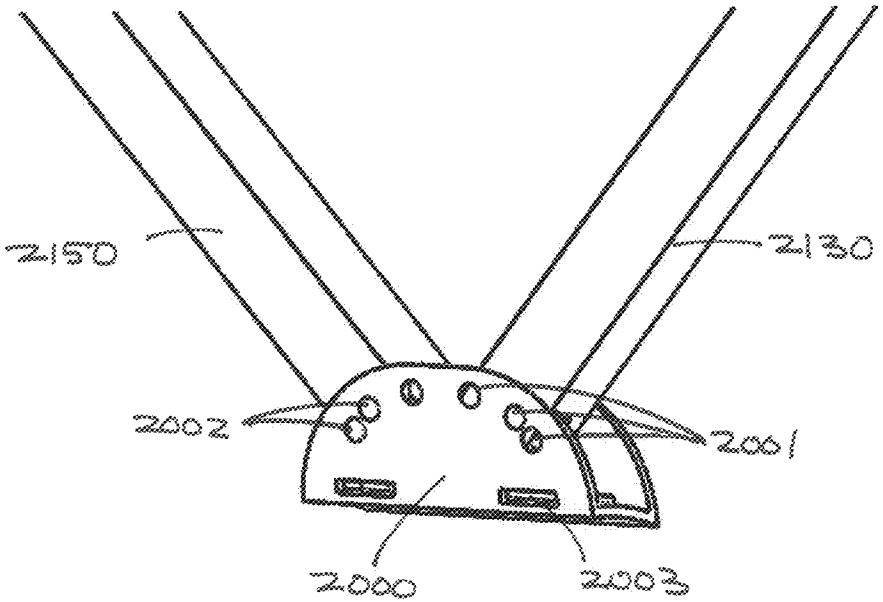
FIG. 22 is an illustration of an embodiment of an adjustable joint.

Additionally, the horizontal base bar on each of support arm bars 130' and 150' may be replaced by an adjustable joint 2000 as shown in FIG. 22. Joint 2000 couples to the segments 2130 and 2150 in an adjustable manner which permit folding of the segments with respect to each other. Joint includes settings 2001 to lock segment 2130 in place and settings 2002 to lock segments 2150 in place. The settings may be push buttons, pins, or other locking mechanisms, as mentioned earlier. Moreover, joint 2000 may be configured with one or more attachment portions 2003 to permit it to be secured to other equipment, such as the arms of a treadmill. A user may, for example, thread straps through portions 2003 to fix the frame assembly onto the arms of a treadmill similar to that shown in FIG. 1.

Figure 23:
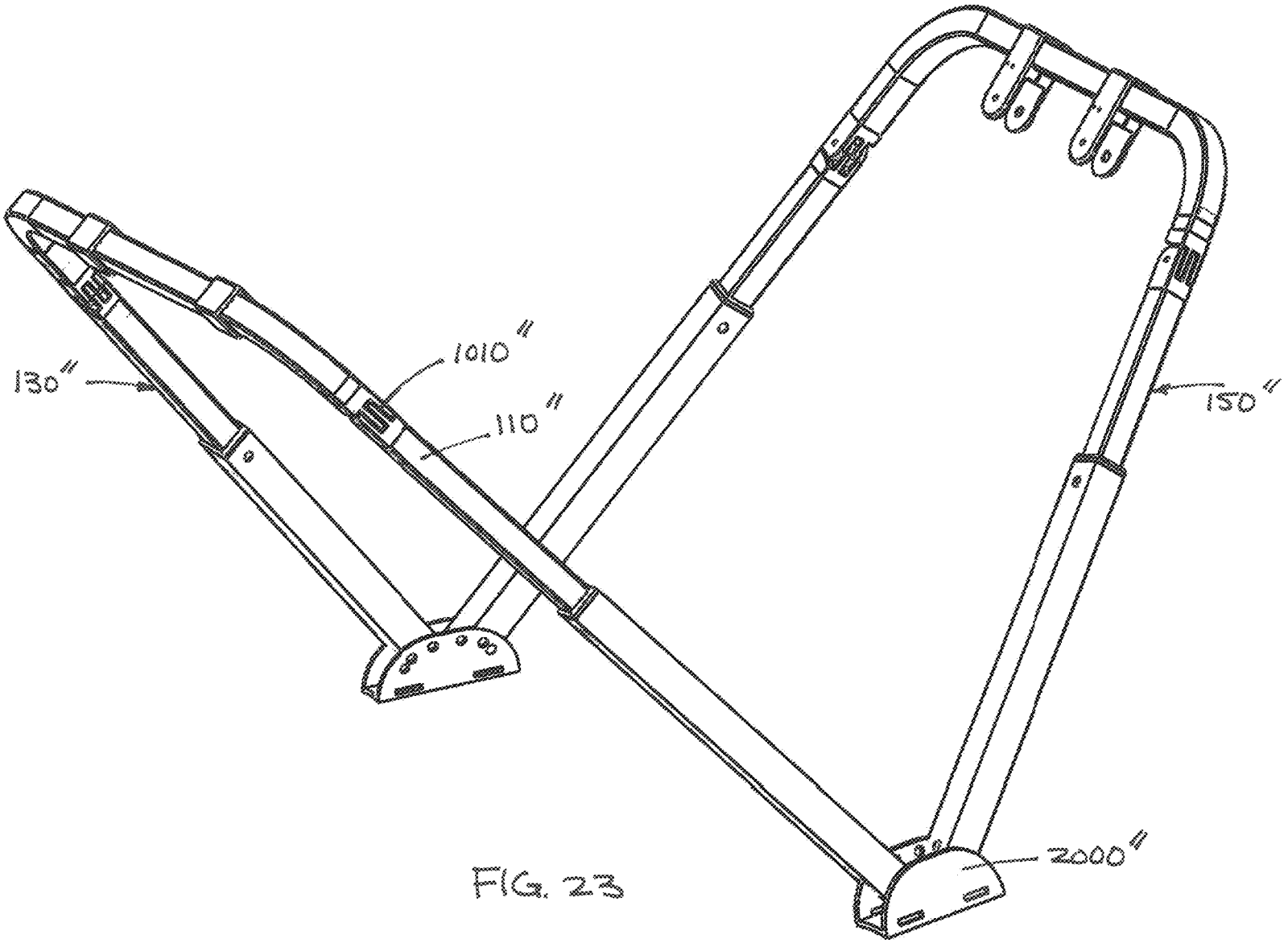
FIG. 23 is an illustration of another embodiment of a frame assembly.
Figure 24:
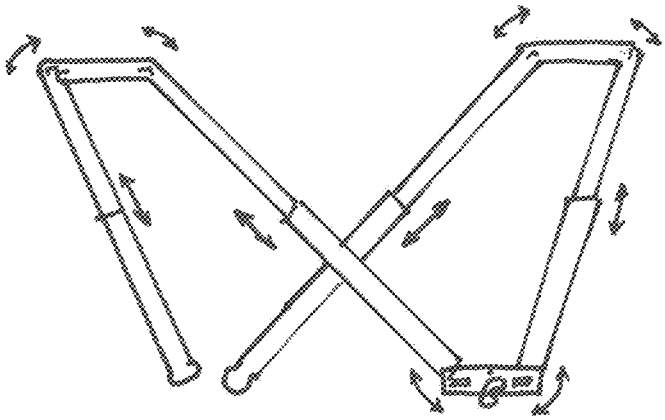
FIG. 24 is an illustration of an embodiment of a frame assembly showing the directions of adjustment.
Figure 27:
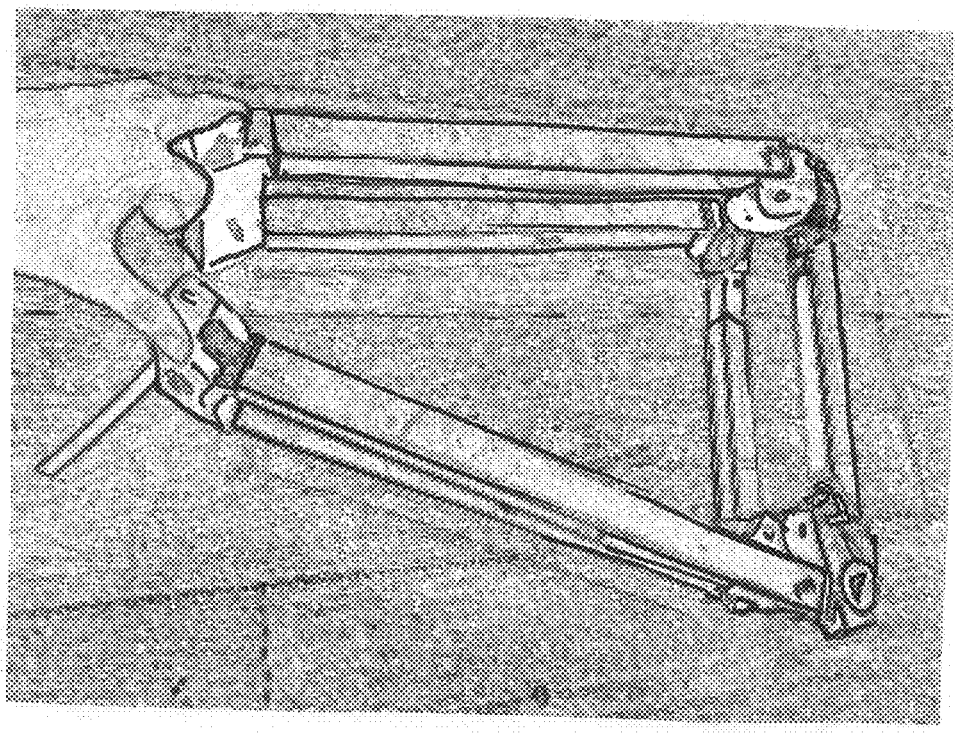
FIG. 27 is an illustration of an embodiment of the suspension system in which the frame assembly has been folded.
Figure 25:
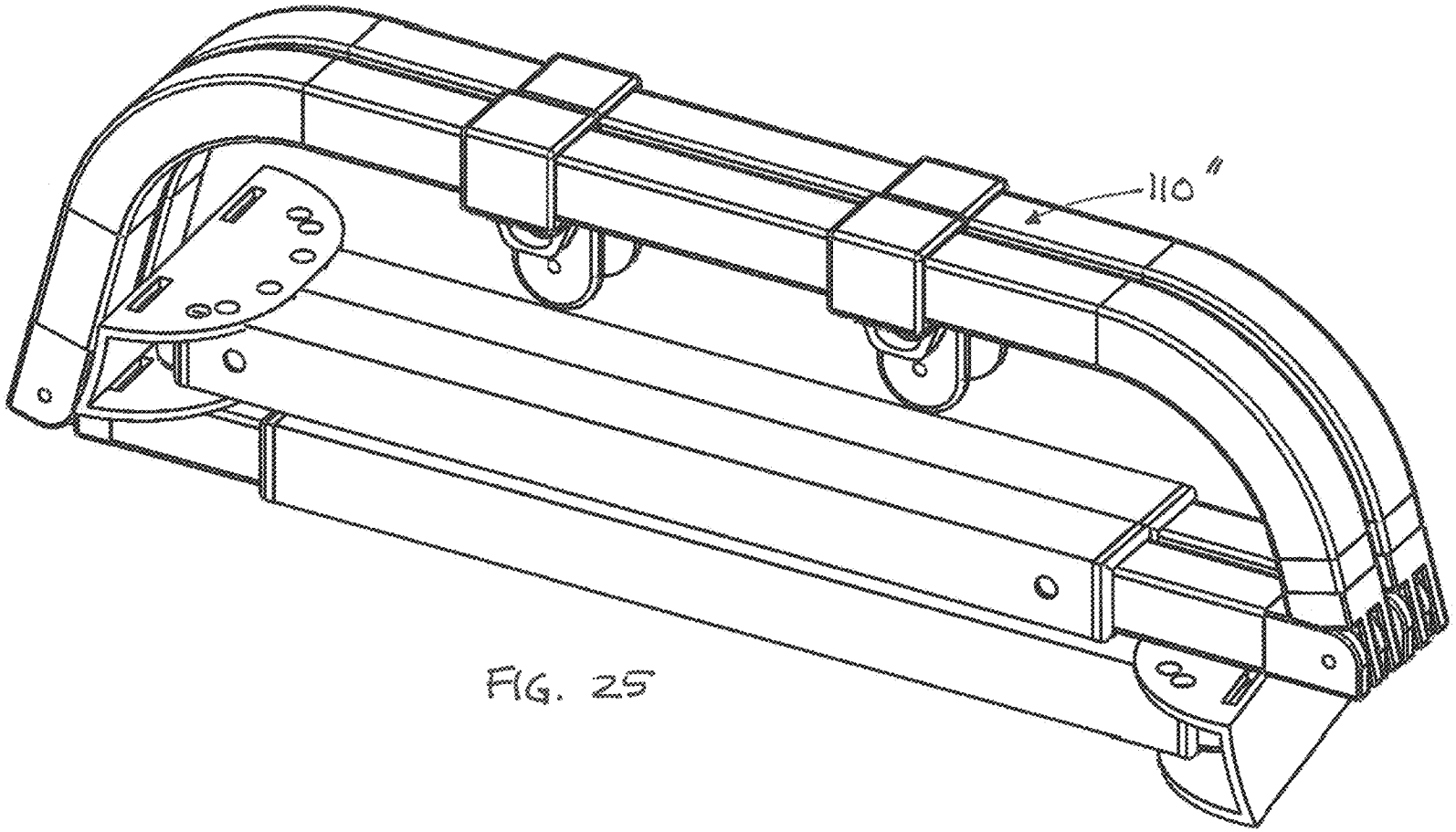
FIG. 25 is a perspective view of an illustration of the frame assembly of FIG. 23 which has been folded.
Figure 26:
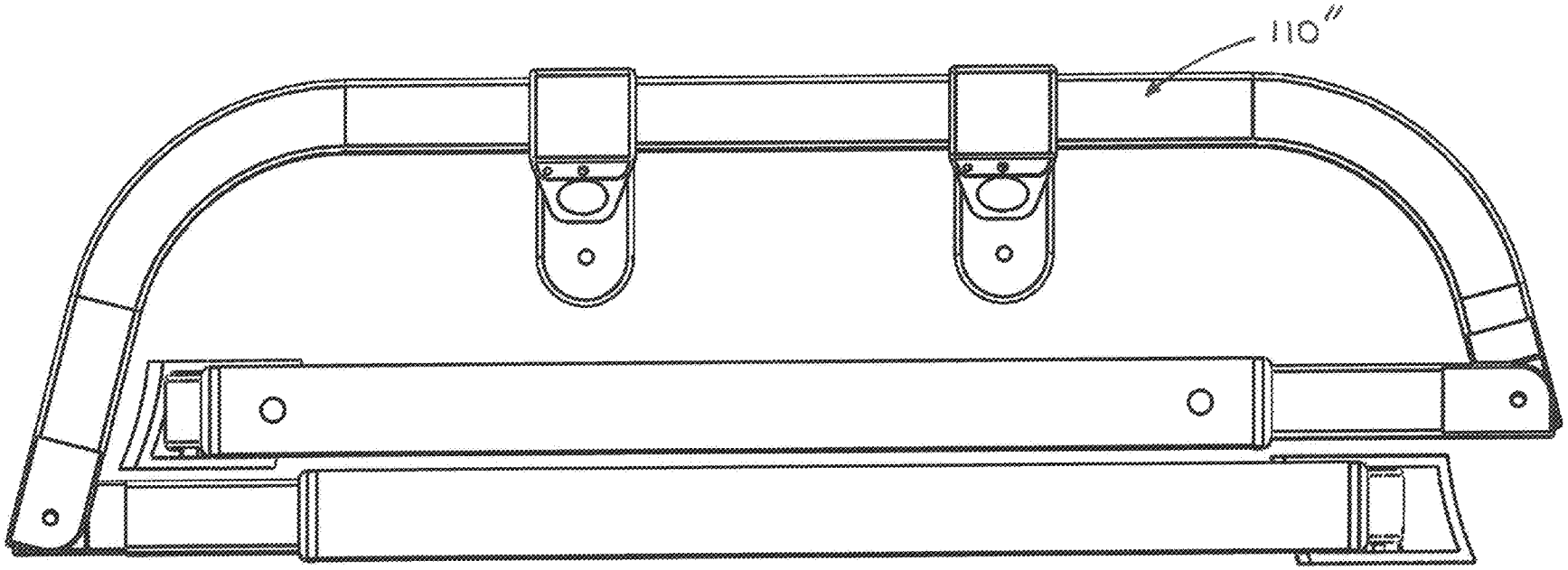
FIG. 26 is a side view of an illustration of the frame assembly of FIG. 23 which has been folded.
Figure 28:
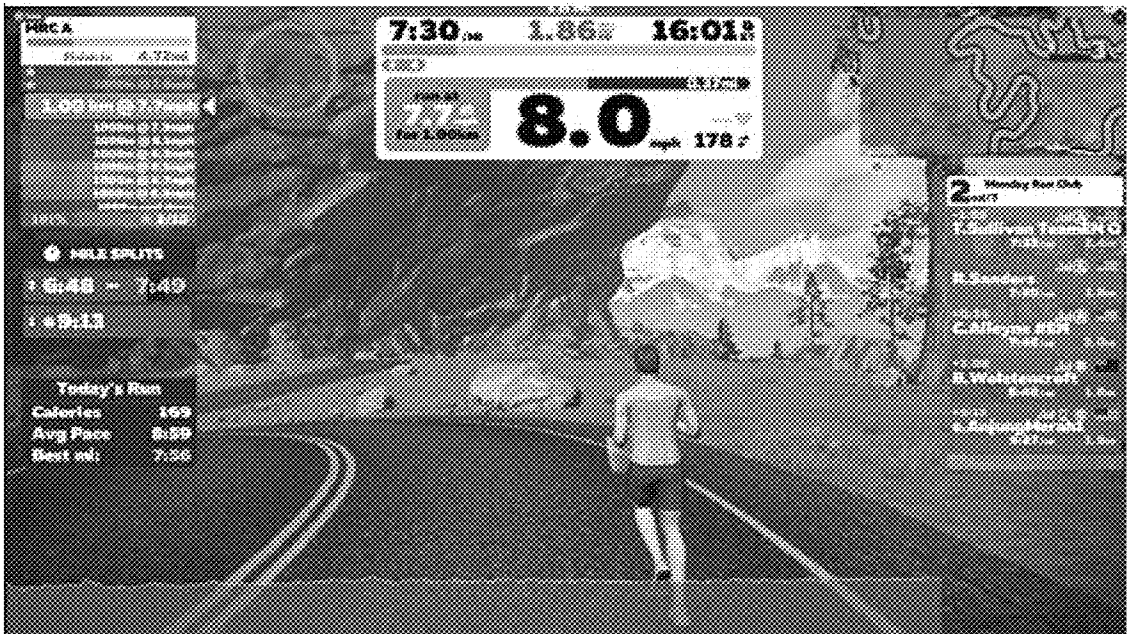
FIG. 28 is an illustration of an embodiment of a user interface for use with the suspension system.
Figure 29:
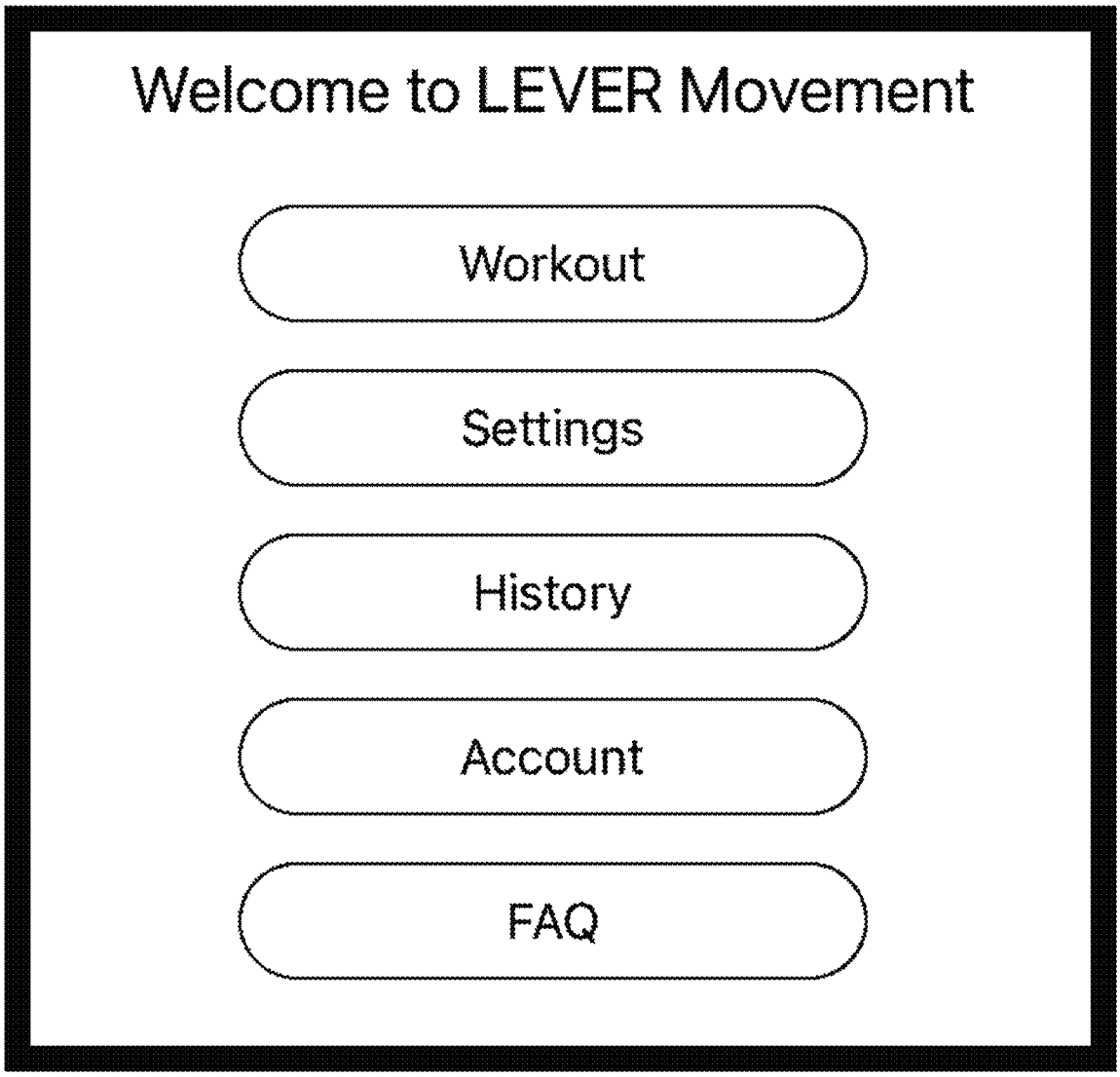
FIG. 29 is an illustration of another embodiment of a user interface for use with the suspension system.
Figure 30:
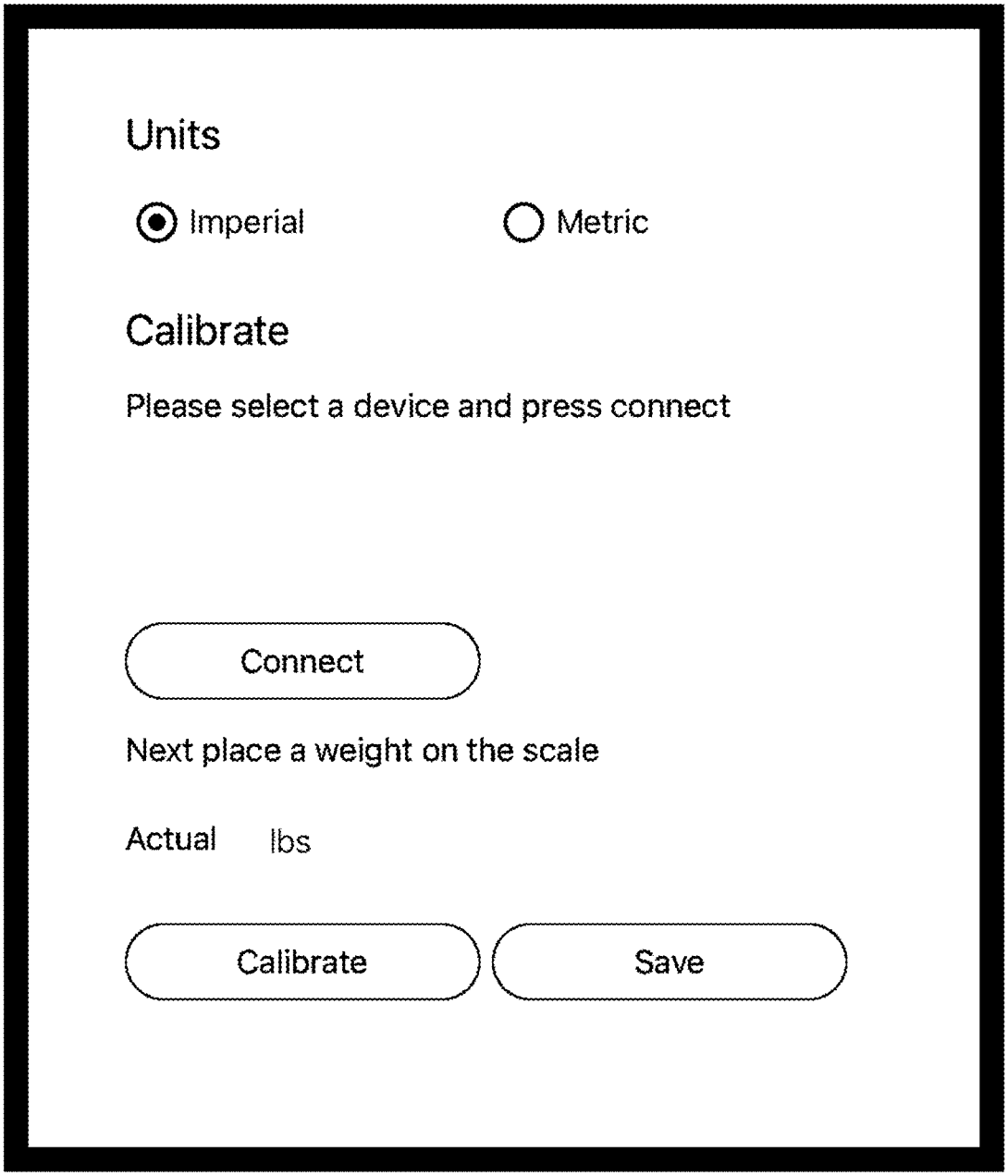
FIG. 30 is an illustration of another embodiment of a user interface for use with the suspension system.
Figure 31:
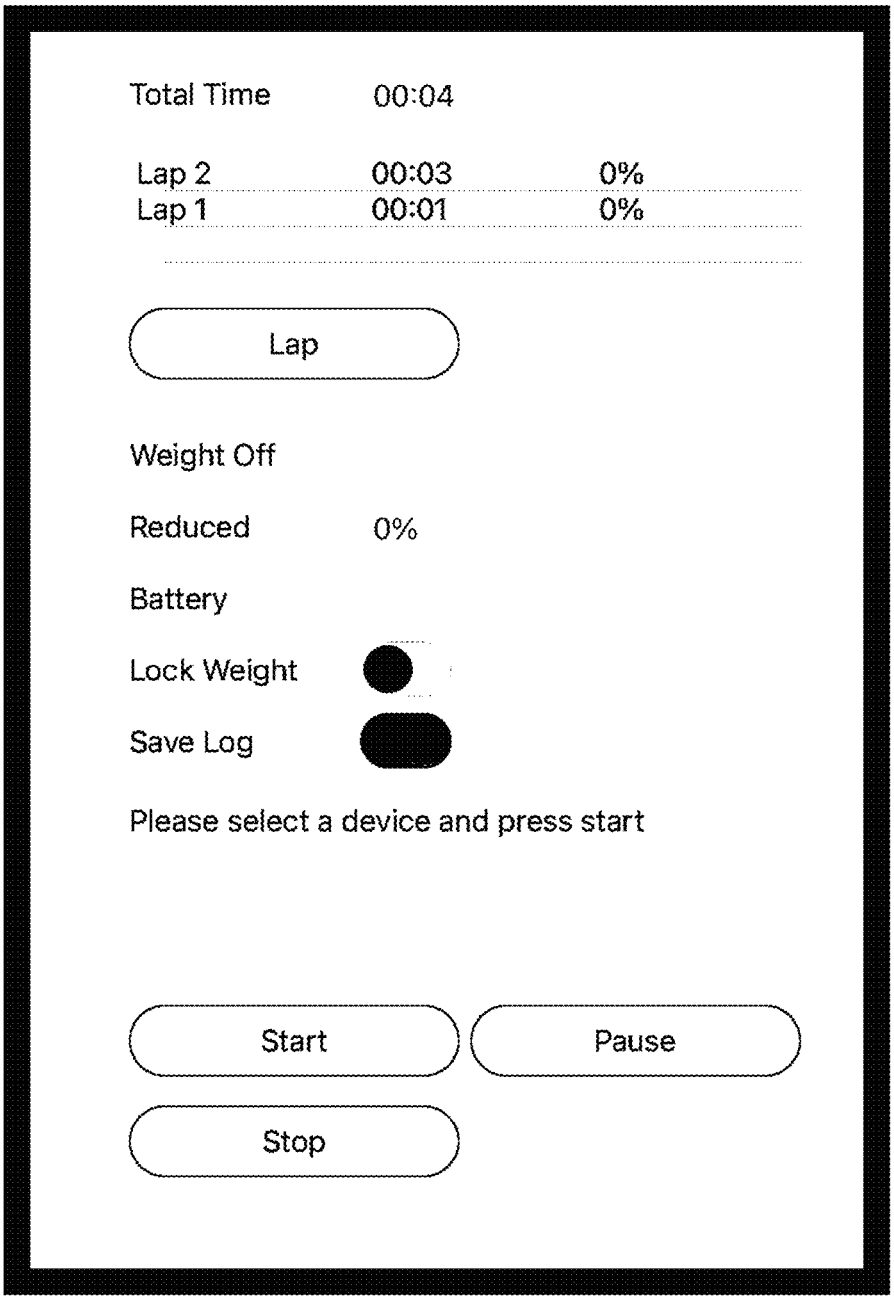
FIG. 31 is an illustration of another embodiment of a user interface for use with the suspension system.
Figure 32:
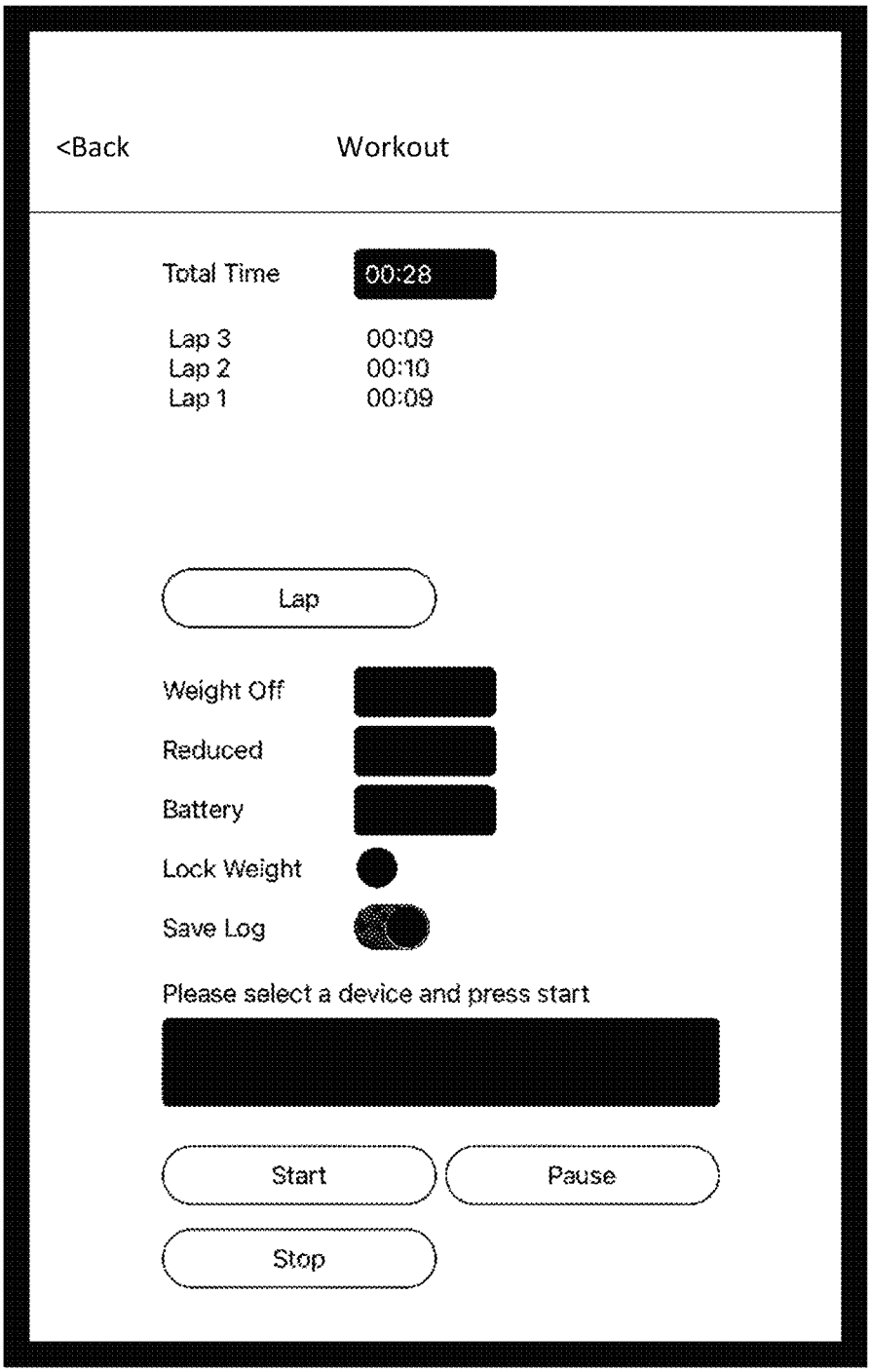
FIG. 32 is an illustration of another embodiment of a user interface for use with the suspension system.

FIG. 23 shows a frame assembly 110" which incorporates adjustable joints 2000". Frame assembly 110" includes foldable joints 1010". It also includes telescoping portions on the support arm bars 130" and 150". Again, parts similar to those shown in other embodiments are numbered similarly. FIG. 24 is a schematic of a frame assembly that may fold and telescope. The arrows indicate the possible directions of movement and adjustment. FIG. 25 is a perspective view of the frame assembly 110" folded. FIG. 26 shows the folded assembly 110" from the side. FIG. 27 is another illustration of a frame assembly which has been folded into a small size for transport. As a size reference, a typical human hand is shown gripping the frame assembly.

Additionally, as shown in FIG. 2B, the support arm bars 130' and 150' are telescoping. Support arm bar 130' includes telescoping portions 1301 and 1303 on one side and 1302 and 1304 on the other. Similarly, support arm bar 150' includes telescoping portions 1051 and 1503 on one side and 1502 and 1504 on the other. These telescoping portions may be locked in place with a push button, pin, or other mechanism as described earlier.

The frame assembly 110 (FIG. 2A), or any other embodiments thereof, can be readily assembled from parts such as the cross bars 120 and 140 and the base/support bars 130 and 150. The cross bars 120, 140 and base/support bars 160, 180 can be attached to each other by any number of attachment fasteners/mechanisms. As shown in the non-limiting embodiment in FIG. 2A, the cross bars 120, 140 attach to the base/support bars 130, 150 by sliding into the ends of the base/support bars 130, 150 and then being held in place by a series of locking pins and holes, which allow for rapid, convenient assembly and disassembly of the frame 100 of the system 100. Alternatively, the bars can be held in place with each other by any of a number of fasteners including, but not limited to, screws, nuts and bolts, cotter pins, latches, male/female couplers, and the like. Alternatively, the entirety of the frame assembly, or a portion of it, may be constructed from retracting members held together with flexible tubing as is done with folding tent poles.

Once the frame assembly 110, or any of the other embodiments, is assembled, the suspension system within the frame can be rapidly and easily assembled. For example, one end of the elastic cord 200 can be attached on the front cross bar 120 at point 210. The free end of the elastic cord can then be fed through first pulley 242, then the rear attachment point 220 on the rear cross bar, next through second pulley 244, and finally through attachment point 230 on the front cross bar.

In the alternative, embodiment shown in FIG. 3, the frame 310 can be readily assembled as described above for the frame assembly 110 in. Once the treadmill frame 310 is assembled, the suspension system within the frame can be rapidly and easily assembled. For example, one end of the elastic cord 400 can be attached on the front cross bar 320 at point 410. The free end of the elastic cord can then be fed through first pulley 442, then the first rear attachment point 420 on the rear cross bar, next through the second rear attachment point 422, then through second pulley 444, and finally through attachment point 430 on the front cross bar. The pulleys may be attached to a leg garment by support straps 446. Similarly, the folded embodiments (e.g. FIGS. 23-27) can be quickly unfolded to obtain the frame assembly. The frame assembly is then assembled with the suspension system and cord as described above. Likewise, any telescoping arms may be adjusted to obtain the desired dimensions for the frame assembly. The remainder of the system is then set up as already described.

The ease by which the presently disclosed suspension system can be assembled enables it to be readily portable, such that it can easily be transported and easily and rapidly assembled for use. The system components can be made of lightweight material and sized to further enhance its mobility. For example, the system can be made of materials that include, but are not limited to, aluminum, carbon fiber, steel, and so on. Accordingly, the weight of the system can vary from as little as 2-3 lbs. up to 4-5 lbs., 6-10 lbs., 11-20 lbs., 21-30 lbs., 31-40 lbs., 41-50 lbs., and so on. The ability to manufacture the presently disclosed system such that it weighs 50 lbs. or less, and down to as little as 6-10 lbs., 4-5 lbs. or 2-3 lbs., distinguishes it from other anti-gravity suspension devices, which weigh considerably more and are not as readily transported. The simple, straightforward convenience of assembly of the presently disclosed system further distinguishes it from other anti-gravity suspension devices, which are more cumbersome and more time consuming to assemble.

In addition to the weight of the components of the system, its mobility and ease of assembly is further contributed to by including parts that are sized for easy assembly and transport. For example, the frame assembly can be assembled from two base/support bars (such as 330 and 350 in FIG. 3) and two cross bars (such as 320 and 340 in FIG. 3), in which the generally V-shaped base/support bars are about 27 inches long and 13 inches deep, and the generally U-shaped cross bars are about 33 inches long and 14 inches deep. Using these preferred dimensions, the entire system can be contained within a bag or similar container that is merely 33 inches long by 15 inches wide and 4 inches deep. Folding capabilities enhance these benefits. As one example, the overall dimensions of the folded frame assembly as depicted in FIG. 27 is 22 inches long by 6 inches wide by 3 inches high-sufficiently small to fit inside a carry-on luggage for air travel. Coupling these dimensions with the light weight of the system makes it very mobile, given the system's ease of transport and assembly. Addition of more telescoping and folding capability reduces these dimensions even further.

Figure 5:
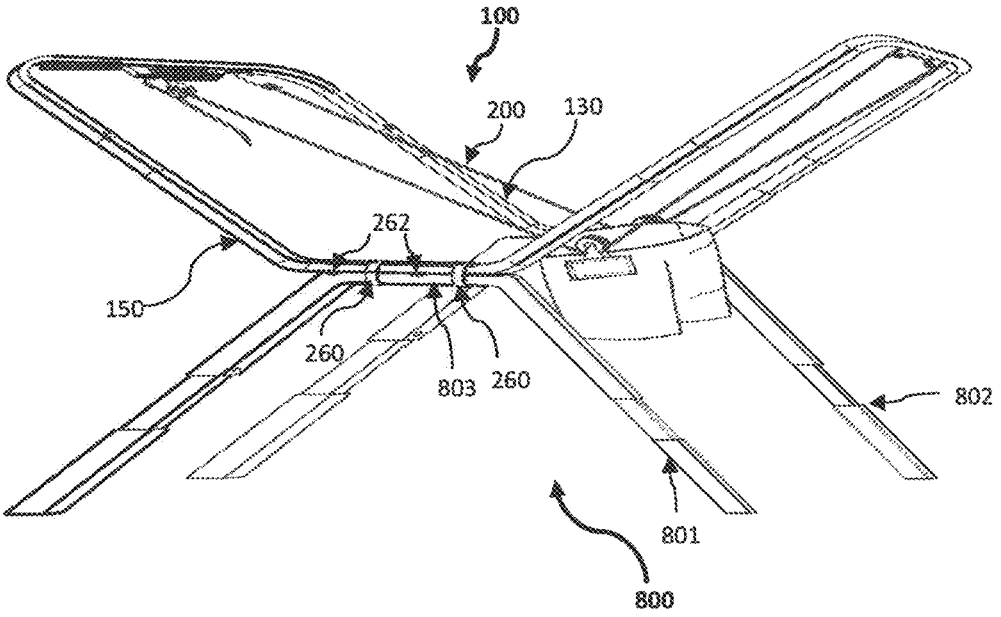
FIG. 5 is an illustrated view of stand coupled to the system as shown in FIG. 2A.

Turning to FIG. 5, an exemplary stand 800 is coupled to the system 100 shown in FIG. 2A. This configuration is designed for use when the exercise equipment (e.g. treadmill) lacks arms or does not have sufficiently positioned and/or sized supports for placing the frame assembly on the device. Accordingly, a stand 800 can be used to place the system 100 on or over equipment (e.g. over a treadmill without arms). For example, the stand 800 could be placed on lower edges of the treadmill outside of the moving tread, or entirely outside a treadmill so as to position the system 100 over the treadmill. The stand 800 stabilizes and positions the system 100 at a desired height and position.

The stand 800 as shown in FIG. 5 has a first leg 801 and a second leg 802. Each leg as portrayed has a first angled support bar, a horizontal base bar 803 and a second angled support bar. Each of first leg 801 and second leg 802 are adjustable in height as desired by the user and to accommodate various heights.

The system 100 is configured to lie flat on each of the horizontal base portions 803 of the first leg 801 and second leg 802 of stand 800. Two coupling straps 260 on base/support bar 150 of the system 100 securely and removably attaches to the flat base portion 803 of the first leg 801 of a stand 800. Likewise, two coupling straps 260 (FIG. 2A) on base/support bar 130 are securely and removably coupled to the flat base portion 803 of the second leg 802 of the stand 800. The straps 260 can be securely closed and fastened around the legs 801 and 802 of the stand 800 by any of a number of non-limiting fasteners, such as straps with holes that feed through a buckle, snaps, hook and loop fasteners, and so forth. The straps 260 themselves can be made of any of a number of materials such as, but not limited to, rubber, nylon, and other materials that impart the strength, flexibility, and durability required for the straps 260 to securely hold the system 100 onto the stand 800. The stability of the frame 110 on the legs 801 and 802 of the treadmill is further enhanced by perpendicular flat bars 262 that provide additional, flat surface area of the frame 110 relative to the legs 801 and 802 of the stand 800. While this embodiment has been described with respect to straps 260, any coupling mechanism including bolts, other fasteners, clamps, clips, latches and the like may be used to secure the stand to the frame assembly.

Figure 6A:
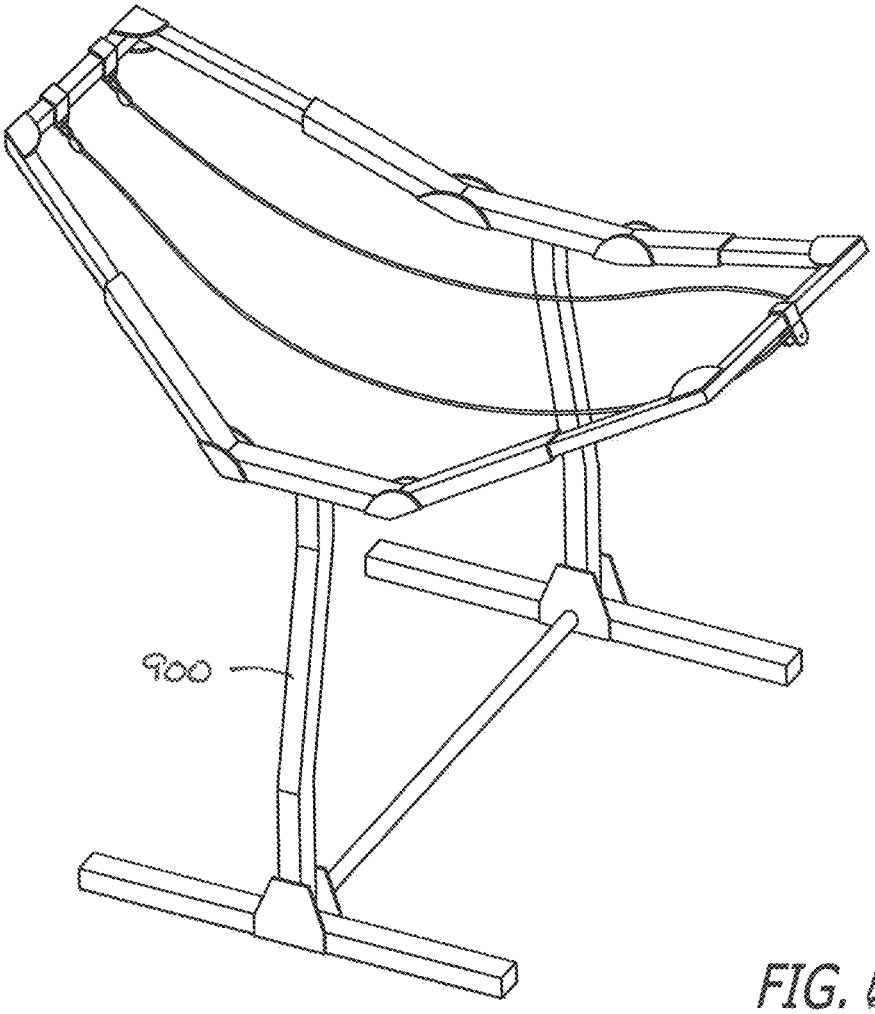
FIG. 6A is an illustrated view of another embodiment of a stand coupled to the system as shown in FIG. 2B.

FIG. 6A shows an alternative configuration of a stand at 900. Stand 900 is for a similar purpose and functions similarly to stand 800 but includes a smaller footprint. Either stand can be used in applications where mounting the frame assembly on a stand would be desirable. Moreover, various changes in the shape and configuration of the stand are within the scope of those or ordinary skill and are contemplated here.

Figure 6B:
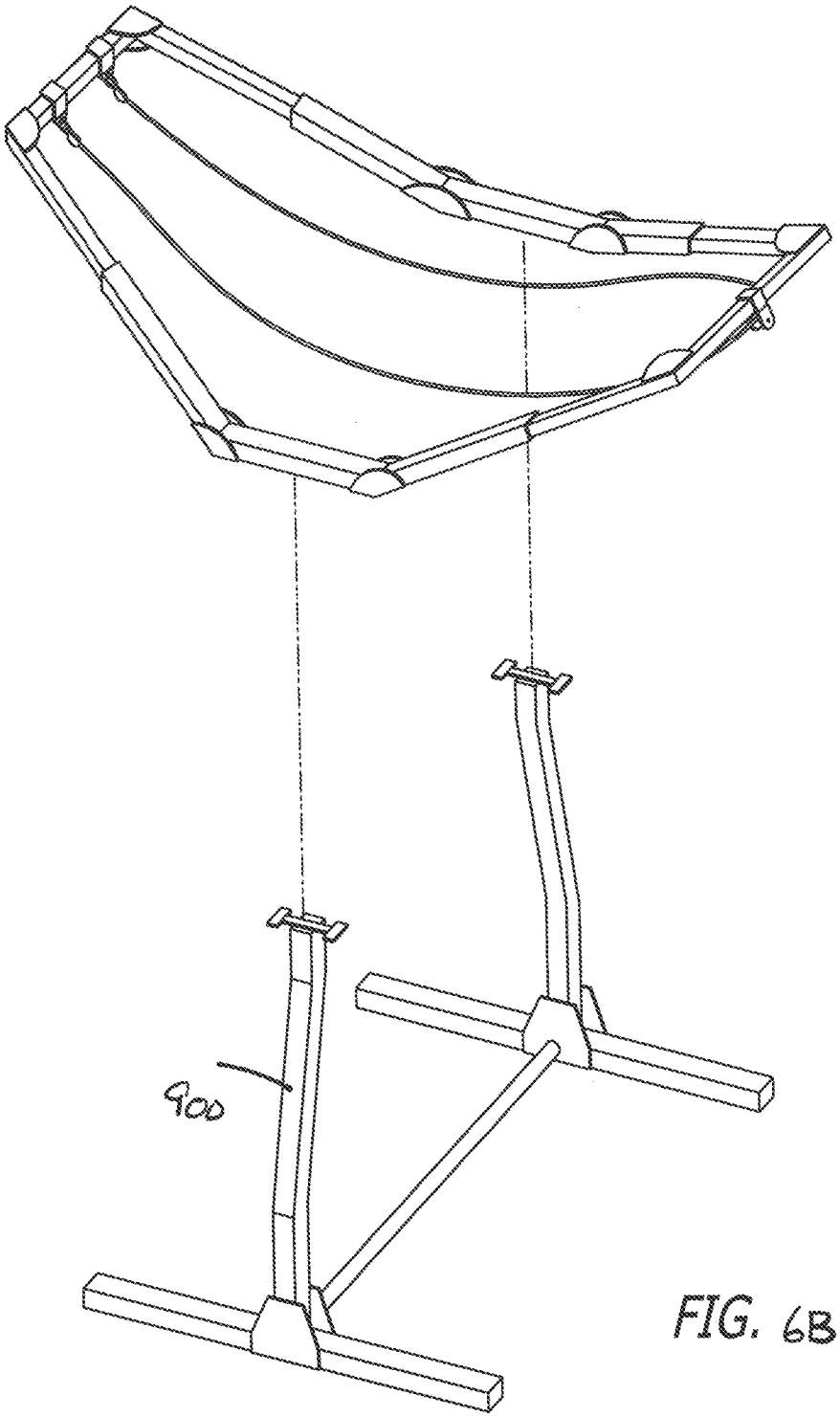
FIG. 6B is an exploded view of a stand and frame assembly as shown in FIG. 6A.

FIG. 6B illustrates the frame assembly and stand 900 in an exploded view. The stand may be secured to the frame assembly in a detachable or permanent fashion. Some examples of detachable couplings include straps, bolds, clamps, clips, latches, and the like. These couplings may be equally used to detachably or permanently attach any stand to any embodiment of the frame assembly.

Figure 9:
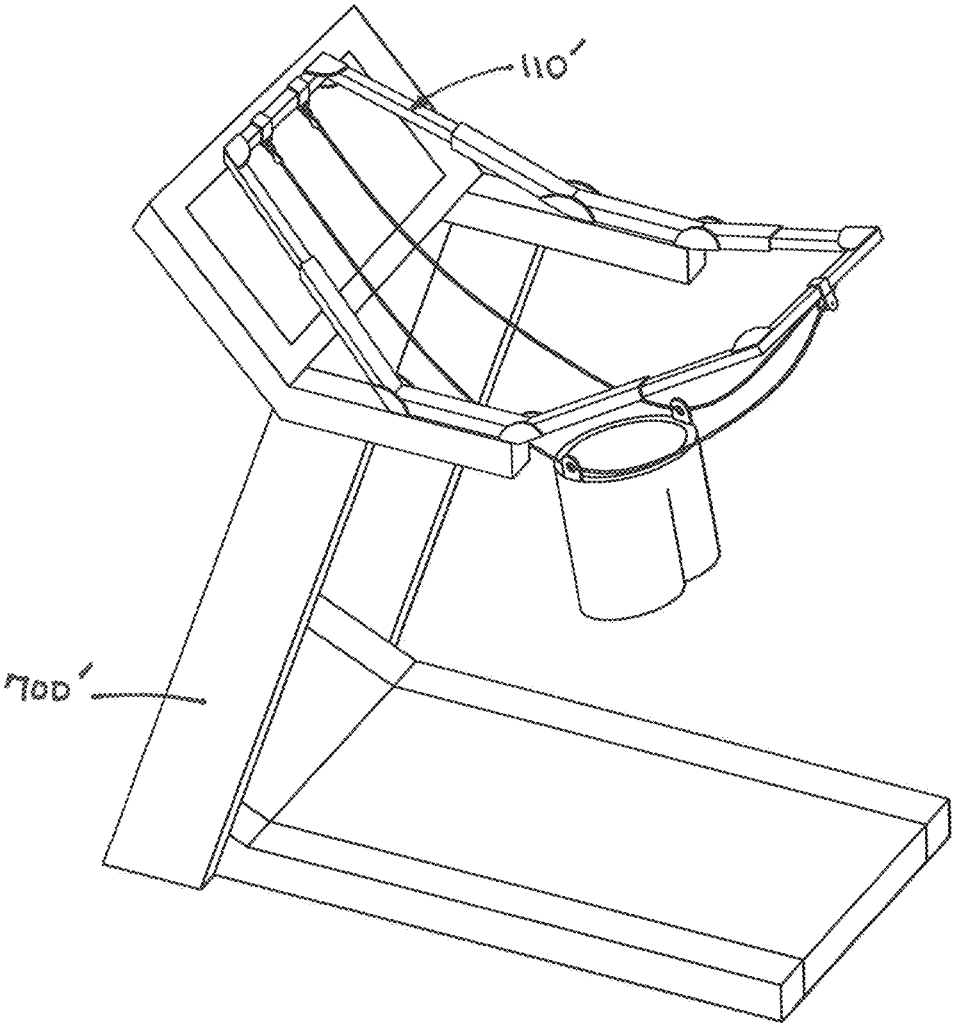
FIG. 9 is an illustration of a treadmill which is preconfigured with an embodiment of the present system incorporated within.

In yet another alternative embodiment, the frame assembly and the suspension mechanism can be fully or partially incorporated into another exercise device. For example, the system 100 as shown in FIG. 1, may be incorporated into the treadmill itself. For applications where the user desires to selectively have the suspension system present, it may be preconfigured into the equipment or treadmill. FIG. 9 shows one example of this preconfiguration.

In FIG. 9, frame assembly 110' is incorporated into treadmill 700'. This incorporation may be achieved a number of ways including embedding portions of the frame assembly into the treadmill or making them integral with the treadmill. For example, the front of a treadmill may function as the front cross bar to which the side base and angled support arm bars connect. Alternatively, the front cross bar may be externally or internally fixed to the front of the treadmill. The angled support arm bars may be coupled to the treadmill or the front cross bar externally, or may be embedded into side portions of the treadmill and may be lifted out and into place during use. They may then be folded and put away after use. The rear cross bar may be coupled to the horizontal bar on the angled support arm bars and may rotate towards the rear of the treadmill in preparation for use. The system may then be used as described above. After use, the user may then rotate the rear cross bar forward into a folding position and rest it on the front of the treadmill or the front cross bar. Alternatively, the rear cross bar may snap on during use and snap off afterwards for storage.

As would be readily understood by those of ordinary skill, these teachings apply to any embodiment of the system incorporated into any other equipment, for example the weight rack depicted in FIG. 8A or a dip rack and the like.

The above teachings have been described with respect to weight reduction. Sometimes, exercise or rehabilitation requires an increase in weight. For those applications, the present system may be adapted to provide a downward force to supplement the force of gravity and increase the apparent weight experienced by the user. In applications such as dips, pullups, and the like, the present system may couple to the user for example by coupling to their feet to increase their apparent weight. In one configuration, the deck (FIG. 7A) may include or be replace by booties worn by the user or straps or clamps which couple to the user's feet or leg.

In the various embodiment, the elastic cord can be routed over the pulley wheel, or other attachment point on the shorts and adjusted in height to provide downward pressure. In such applications, if the rear attachment point is replaced by the cam device (e.g. FIG. 19), the amount of downward pressure (or upward pressure in anti-gravity applications) may be more finely controlled by controlling the tension on the cord. In these types of applications, the length of the elastic cord 200 may have multiple segments which are each coupled to the front and rear cross bars at separate attachment points. Alternative, multiple lengths of the cord may be used. Alternatively, the ends of the segments may be configured with fasteners, such as hooks (FIG. 14) which can be attached in any configuration to any of a number of preconfigured attachment points for different affect. The ends of the segments (or cord 200) may additionally be coupled to couplings which allow the length or tension of the cord or segments to be adjusted, as mentioned above. Moreover, micro motors and other power devices may be used as the coupling to enable tensioning and change of length to occur via electronic control means.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A suspension system for use during physical exercise comprising:

a frame assembly containing a first cross member and a second cross member;

an elastic cord having a length and suspended within the frame assembly between the first and second cross members with a first end of the elastic cord securely attached to the first cross member at a first attachment point, wherein the elastic cord traverses from the first cross member to the second cross member and loops back to the first cross member at a second attachment point;

wherein the elastic cord couples with the second cross member at a third attachment point, wherein the elastic cord is configured to freely slide through the third attachment point;

wherein the elastic cord is configured to couple to a user at a location between the first and second cross members;

wherein the elastic cord exerts an equalized force which is configured to either augment or reduce the force of gravity on the user.

2. The suspension system according to claim 1 further comprising apparel coupled to the said elastic cord along said length.

3. The suspension system according to claim 2 wherein the apparel includes at least one pulley coupled to said elastic cord along said length.

4. The suspension system according to claim 1 further comprising a sensor coupled to the elastic cord such that the sensor is configured to sense the force on the elastic cord.

5. The suspension system according to claim 4 wherein the sensor is in communication with a graphical user interface.

6. The suspension system according to claim 1 wherein the force augments the force of gravity.

7. The suspension system according to claim 6 wherein the force augmentation is communicated to a display device.

8. The suspension system according to claim 1 wherein the force reduces the force of gravity.

9. The suspension system according to claim 8 wherein the force reduction is communicated to a display device.

10. The suspension system according to claim 1 wherein the suspension system is permanently incorporated into another exercise equipment.

11. The suspension system according to claim 10 wherein said exercise equipment is a treadmill.

12. The suspension system according to claim 1 wherein the frame assembly is configured to fold into a size which may be placed into a carry-on sized luggage.

13. The suspension system according to claim 1 configured such that a tension in said elastic cord is changed as a result of remote communication from a user.

14. The suspension system according to claim 1 wherein the frame assembly is foldable.

15. The suspension system according to claim 1 wherein the frame assembly is telescoping.

16. The suspension system according to claim 1 wherein the frame assembly includes one or more cams coupled to the elastic cord.

17. The suspension system according to claim 1 wherein the first and second cross members are attached so that they are capable of rotating towards and away from each other.

18. A method of exercise comprising the steps of:

providing a frame assembly containing a first cross member and a second cross member; the frame assembly coupled to an elastic cord having a length and suspended within the frame assembly between the first and second cross members with a first end of the elastic cord securely attached to the first cross member at a first attachment point; wherein the elastic cord traverses from the first cross member to the second cross member and loops back to the first cross member at a second attachment point; wherein the elastic cord couples with the second cross member at a third attachment point; wherein the elastic cord can freely slide through the third attachment point; wherein the elastic cord is configured to couple to a user at a location between the first and second cross members; wherein the elastic cord exerts an equalized force which is configured to either augment or reduce the force of gravity on the user;

coupling to said elastic cord along said length;

exerting forces on the elastic cord resulting from movement of the user;

wherein the force exerted by the elastic cord increases or decreases the weight of the user.

19. A method of making a suspension system for exercise comprising providing a frame assembly containing a first cross member and a second cross member;

providing an elastic cord having a length;

coupling said elastic cord to the frame assembly; wherein the elastic cord is configured to be suspended within the frame assembly between the first and second cross members with a first end of the elastic cord securely attached to the first cross member at a first attachment point; wherein the elastic cord is configured to traverse from the first cross member to the second cross member having a second attachment point; wherein the second cross member includes a third attachment point;

providing hardware to couple to the elastic cord at least one of the first, second, or third attachment points;

configuring at least one point along the length of the elastic to be weighted by a user.

20. A product made by the process according to claim 19.

* * * * *